US010369570B2

(12) United States Patent
Hadwen et al.

(10) Patent No.: US 10,369,570 B2
(45) Date of Patent: Aug. 6, 2019

(54) MICROFLUIDIC DEVICE WITH DROPLET PRE-CHARGE ON INPUT

(71) Applicants: Sharp Life Science (EU) Limited, Oxford (GB); SHARP KABUSHIKI KAISHA, Osaka (JP)

(72) Inventors: Benjamin James Hadwen, Oxford (GB); Sinéad Matthews, Oxford (GB); Lesley Anne Parry-Jones, Oxford (GB); Adam Robinson, Oxford (GB); Tomohiro Kosaka, Osaka (JP); Takeshi Hara, Osaka (JP); Tomoko Teranishi, Osaka (JP)

(73) Assignees: Sharp Life Science (EU) Limited, Oxford (GB); Sharp Kabushiki Kaisha, Osaka (JP)

( * ) Notice: Subject to any disclaimer, the term of this patent is extended or adjusted under 35 U.S.C. 154(b) by 101 days.

(21) Appl. No.: 15/661,609

(22) Filed: Jul. 27, 2017

(65) Prior Publication Data

US 2019/0030537 A1 Jan. 31, 2019

(51) Int. Cl.
*B01L 3/00* (2006.01)
*B01L 3/02* (2006.01)

(52) U.S. Cl.
CPC ..... *B01L 3/502784* (2013.01); *B01L 3/0241* (2013.01); *B01L 3/50273* (2013.01);
(Continued)

(58) Field of Classification Search
CPC ..... B01L 13/502784; B01L 13/50273; B01L 13/502715; B01L 2300/0887;
(Continued)

(56) References Cited

U.S. PATENT DOCUMENTS 6,565,727 B1 5/2003 Shenderov
6,911,132 B2 6/2005 Pamula et al.
(Continued)

FOREIGN PATENT DOCUMENTS

JP 2013128920 7/2013
JP 2017517725 6/2017
(Continued)

OTHER PUBLICATIONS

Extended European Search Report of EP Application No. 18185572.7 dated Oct. 1, 2018.

*Primary Examiner* — Bach T Dinh
(74) *Attorney, Agent, or Firm* — Renner, Otto, Boisselle & Sklar, LLP

(57) ABSTRACT

An EWOD device includes opposing substrates defining a gap and each including an insulating surface facing the gap. Array elements include electrode elements to which actuation voltages are applied. A pre-charging structure defines a channel in fluid communication with the gap wherein the channel receives an input of a fluid reservoir for generation of the liquid droplet, and the pre-charging structure includes an electrical element electrically exposed to the channel. The electrical element pre-charges the fluid reservoir within the channel, and a portion of the gap containing the liquid droplet spaced apart from the channel is electrically isolated from the electrical element such that the liquid droplet is at a floating electrical potential when located within said portion of the gap. The electrical element may be an electrode portion that is exposed to the channel, or an externally connected pre-charging element inserted into the channel.

8 Claims, 17 Drawing Sheets

(52) U.S. Cl.
CPC ... *B01L 3/502715* (2013.01); *B01L 3/502792* (2013.01); *B01L 2200/027* (2013.01); *B01L 2200/0642* (2013.01); *B01L 2200/0673* (2013.01); *B01L 2200/12* (2013.01); *B01L 2300/089* (2013.01); *B01L 2300/0819* (2013.01); *B01L 2300/0887* (2013.01); *B01L 2300/161* (2013.01); *B01L 2400/0415* (2013.01); *B01L 2400/0421* (2013.01); *B01L 2400/0427* (2013.01)

(58) Field of Classification Search
CPC ..... B01L 2300/089; B01L 2400/0415–0427; B01L 3/502784; B01L 3/50273; B01L 3/502715; G01N 27/447–44795
See application file for complete search history.

(56) References Cited

U.S. PATENT DOCUMENTS

| | | | |
|---|---|---|---|
| 7,163,612 | B2 | 1/2007 | Sterling et al. |
| 8,173,000 | B1 | 5/2012 | Hadwen et al. |
| 8,653,832 | B2 | 2/2014 | Hadwen et al. |
| 8,702,938 | B2 | 4/2014 | Srinivasan et al. |
| 8,815,070 | B2 | 8/2014 | Wang et al. |
| 9,011,662 | B2 | 4/2015 | Wang et al. |
| 9,238,222 | B2 | 1/2016 | Delattre et al. |
| 2005/0179746 | A1* | 8/2005 | Roux ..... F04B 19/006 347/69 |
| 2009/0192044 | A1* | 7/2009 | Fouillet ..... B01F 13/0071 506/7 |
| 2013/0161193 | A1* | 6/2013 | Jacobs ..... B01L 3/502792 204/604 |
| 2013/0168250 | A1 | 7/2013 | Fogleman et al. |
| 2013/0217113 | A1 | 8/2013 | Srinivasan et al. |
| 2014/0008222 | A1* | 1/2014 | Srinivasan ..... B01L 3/0268 204/450 |
| 2015/0323496 | A1 | 11/2015 | Pollack et al. |
| 2017/0136452 | A1 | 5/2017 | Niles et al. |

FOREIGN PATENT DOCUMENTS

| | | |
|---|---|---|
| WO | WO 99/54730 | 10/1999 |
| WO | WO 2017078059 | 5/2017 |

* cited by examiner

FIG. 1: Conventional ART $$\Delta V_{HC2} = V_{LD} - V_{E2}$$

$$V_{LD} = V_0 + \frac{\sum_n \left( C_{HC2} \Delta V_{E2} + C_{EL} \Delta V_{E1(n)} \right)}{C_{TOTAL}}$$

$$\frac{1}{C_{EL}} = \frac{1}{C_{HC1}} + \frac{1}{C_{INS}}$$

$$C_{TOTAL} = n.(C_{EL} + C_{HC2})$$

FIG. 5

MICROFLUIDIC DEVICE WITH DROPLET PRE-CHARGE ON INPUT

TECHNICAL FIELD

The present invention is related to microfluidic devices for performing droplet manipulation operations, such as active matrix electro wetting on dielectric (AM-EWOD) digital microfluidic devices, and more particularly to the controlling of electrical potential of droplets input to the array to improve device performance and reliability.

BACKGROUND ART

Electro-wetting on dielectric (EWOD) is a well-known technique for manipulating droplets of fluid by application of an electric field. The structure of a conventional EWOD device is illustrated in the cross-section diagram of FIG. 1. As shown, the EWOD device includes a lower substrate 30 and an upper (top) substrate 36 arranged opposite the lower substrate 30 and separated from it by a spacer 32 to form a fluid gap 35.

A conductive material is formed on the lower substrate 30 and patterned to form a plurality of individually addressable lower electrodes 38, as depicted in FIG. 1 for example as a first lower electrode 38A and a second lower electrode 38B.

An insulator layer 20 is formed on the lower substrate 30 over the lower electrodes 38 and a lower hydrophobic coating 16 is formed over the insulator layer. The hydrophobic coating is formed from a hydrophobic material. The hydrophobic material is commonly, but not necessarily, a fluoropolymer. A conductive material is formed on the upper (top) substrate 36 and acts as a common reference electrode 28. An upper hydrophobic coating 26 is formed over the common reference electrode 28. Optionally, a further insulator layer (not shown) may be interposed between the common reference electrode 28 and the upper hydrophobic coating 26.

The fluid gap is filled with a non-polar filler fluid 34, such as oil, and liquid droplets 4. The liquid droplet 4, commonly an aqueous and/or ionic fluid, includes a polar material and is in contact with both the lower hydrophobic coating 16 and the upper hydrophobic coating 26. The interface between the liquid droplet 4 and filler fluid 34 forms a contact angle Θ 6 with the surface of the lower hydrophobic coating 16.

In operation, voltage signals are applied to the lower electrodes 38 and common reference electrode 28 so as to actuate the liquid droplet 4 to move within the fluid gap 35 by the EWOD technique. Typically, the lower electrodes 38 are patterned to form an array, or matrix, with each element of the array comprising a single individually addressable lower electrode 38. A plurality of droplets may therefore be controlled to move independently within the fluid gap 35 of the EWOD device. Exemplary EWOD devices are illustrated in the following:

U.S. Pat. No. 6,565,727 (Shenderov, issued May 20, 2003) discloses an EWOD device with a passive type array for moving droplets.

U.S. Pat. No. 6,911,132 (Pamula et al., issued Jun. 28, 2005) discloses an EWOD device with a two-dimensional array to control the position and movement of droplets in two dimensions.

U.S. Pat. No. 8,815,070 (Wang et al., issued Aug. 26, 2014) describes an EWOD device in which multiple microelectrodes are used to control the position and movement of a droplet.

U.S. Pat. No. 8,173,000 (Hadwen et al, issued May 8, 2012) discloses an EWOD device with improved reliability by means of application of an AC voltage signal to the common reference electrode.

Active Matrix EWOD (AM-EWOD) refers to implementation of EWOD in an active matrix array incorporating transistors within each element of the array. The transistors may be, for example, thin film transistors (TFTs), and form an electronic circuit within each array element to control the voltage signals applied to the lower electrodes.

U.S. Pat. No. 7,163,612 (Sterling et al., issued Jan. 16, 2007) describes how TFT based thin film electronics may be used to control the addressing of voltage pulses to an EWOD array by using circuit arrangements very similar to those employed in active matrix display technologies.

U.S. Pat. No. 8,653,832 (Hadwen et al, issued Feb. 18, 2014) discloses an AM-EWOD device in which each element in the array includes circuitry to both control the voltage signals applied to the lower electrode and to sense the presence of a liquid droplet above the electrode.

As to certain particular aspects of EWOD device operation, U.S. Pat. No. 8,702,938 (Srinivasan et al., issued Apr. 22, 2014) describes an EWOD cartridge where fluid is input through a hole in the top substrate. U.S. Pat. No. 9,238,222 (Delattre et al., issued Jan. 19, 2016) describes reducing bubble formation adjacent the droplet by maintaining substantially consistent contact between the droplet and an electrical ground during droplet operations to prevent such bubble formation. U.S. Pat. No. 9,011,662 (Wang et al., issued Apr. 21, 2015) similarly teaches that it is preferred that droplets remain in continuous contact or frequent contact with a ground or reference electrode.

Problem to be Solved by the Invention

The droplet potential, electro-wetting potential, and potential across the top substrate insulator formed by the hydrophobic coating can be electrically modeled. In the region of a liquid droplet, the potential difference across the top hydrophobic coating layer is related to the voltages applied to the corresponding element electrodes, the voltage applied to a second common reference electrode, and the capacitance of the capacitors formed within each element of the array of elements in the device. Such potential difference is affected by a DC offset referred to herein as "$V_0$", corresponding to an initial potential of the liquid droplet when the droplet is inputted into the device.

The electrical potential $V_0$ depends on how the droplet is input into the device. The droplet input, for example, may be performed by a user (e.g. by pipette), from a fluidic chamber, from another microfluidic device, or the like. In the absence of specific measures to control $V_0$, this potential across the top hydrophobic layer is subject to variability, and in particular, for example, may depend on the nature of the non-conductive structures used to put the droplet into the input well, user pipetting technique, and/or the external electrostatic environment (including factors such atmospheric humidity, and the like).

If the level of the DC offset voltage $V_0$ assumes an unwanted value, this can have various deleterious effects. For example, such an unwanted $V_0$ value may result in an unwanted DC offset potential between the droplet and the top substrate electrode, which can cause damage (e.g. bubbles, breakdown) of the top substrate insulator or hydrophobic layer. An unwanted $V_0$ value further may result in a large DC offset potential between the droplet and the bottom substrate electrode, which can cause damage by dielectric breakdown of the insulating layers, causing catastrophic device failure. Such an unwanted $V_0$ value further can offset the DC potential between the droplet and the TFT substrates electrode, to a reduced value from which the device is designed to operate. This in turn may reduce performance by reducing the electro-wetting actuation force, which for example can result in poor or unreliable splitting/dispensing of droplets and/or lower move speed of droplets. This may occur, for example, if the DC voltage is between the top electrode and TFT electrode potential. The present invention solves these problems by being configured and operated to avoid an unwanted value of the DC offset voltage $V_0$.

SUMMARY OF INVENTION

The present invention pertains to enhanced configurations for an EWOD device, and AM-EWOD devices in particular, that avoid an unwanted value of the DC offset voltage $V_0$. As referenced above, the EWOD device of the present invention is configured and operated to avoid an unwanted value of the DC offset voltage $V_0$.

To accomplish such result, an input fluid reservoir from which droplets are formed is pre-charged to have a specified or preset DC potential ($V_0$) at a point of entry of the aqueous liquid reservoir into the EWOD device cartridge. The specified or preset DC potential is preferably selected to minimize an average voltage across the top substrate layer. Accordingly, an EWOD device is configured to incorporate a pre-charging fluid input structure at one or more fluid inputs. In an EWOD device in which the lower and upper hydrophobic coatings are high quality and thus substantially electrically insulating, without the control of the present invention the DC potential of the reservoir in the fluid gap could assume an undesirable arbitrary value. This is disadvantageous, for an inappropriate DC potential may lead to a reduced potential difference between the lower substrate electrode and the droplet, thereby reducing the electro-wetting potential and the ability of the device to drive droplets, and an unwanted DC offset potential between the droplet and the top substrate electrode which may compromise device reliability. The inventors have realized that these potential disadvantages can be negated by pre-charging the fluid reservoir from which droplets are generated to a preset DC potential on input.

With such a configuration, the present invention solves the problems above provided the DC droplet potential $V_0$ is well chosen. In exemplary embodiments, a suitable value of $V_0$ may be selected such that the resultant potential of the top substrate electrode typically ensures that the DC potential between the top substrate electrode and liquid reservoir is zero, or close to zero, and the electro-wetting voltage is maximized. In the conventional configurations described in the background section above (see, e.g., particularly U.S. Pat. Nos. 923,822 and 9,011,662), it is taught to improve performance specifically by having the droplets remain in continuous contact or frequent contact with a ground or reference electrode. The present invention operates differently, whereby the device is configured such that the droplets generated from the initial fluid reservoir have no electrical connection to a DC potential when in the gap defined by the substrates and away from the input. The present invention further has a configuration that sets the DC potential at a specified or preset initialization state when the fluid reservoir is in the fluid input structure. $V_0$ is thus set at a chosen suitable initial potential. Once the fluid reservoir or a droplet drawn therefrom is detached from the fluid input structure, such as for example by moving a droplet away or by dispensing/splitting a droplet out of the fluid input structure, the droplet is at a floating DC potential.

An aspect of the invention, therefore, is an electrowetting on dielectric (EWOD) device having a pre-charging structure for pre-charging a fluid reservoir. In exemplary embodiments, the EWOD device includes a first substrate and an opposing second substrate defining a gap between the first and second substrates, each substrate including an insulating surface facing the gap; an array of elements comprising a plurality of individual elements that are actuatable for manipulation of a liquid droplet within the gap, each individual element including a plurality of electrode elements to which actuation voltages are applied; and a pre-charging structure that includes a channel in fluid communication with the gap and that is configured to receive a fluid reservoir for generation of the liquid droplet, and the pre-charging structure includes an electrical element electrically exposed to the channel. The electrical element pre-charges the fluid reservoir within the channel, and a portion of the gap containing the liquid droplet spaced apart from the channel is electrically isolated from the electrical element such that the liquid droplet is at a floating electrical potential when located within said portion of the gap.

The pre-charging structure may comprise an input structure defining an input channel in fluid communication with the gap, wherein the input channel is the channel that is configured to receive the input of the fluid reservoir, and the electrical element comprises an electrode portion of the plurality of electrode elements that is exposed to the input channel.

Another aspect of the invention is an enhanced method of operating an electro-wetting on dielectric (EWOD) device. The method may include the steps of inputting a fluid reservoir into the EWOD device via a channel defined by the EWOD device; pre-charging the fluid reservoir with an electrical element while the input fluid reservoir is within the channel; and applying an actuation voltage to the EWOD device to generate a liquid droplet from the fluid reservoir and moving the liquid droplet into a gap defined by the EWOD device, wherein the droplet is moved to a portion of the gap that is electrically isolated from the electrical element such that the liquid droplet is at a floating electrical potential when located within said portion of the gap.

In one exemplary embodiment, during pre-charging an electrical potential of the fluid reservoir is initialized at an electrical potential of the reference electrode, wherein upon AC signal transition of the actuation voltage a potential difference between the liquid droplet and reference electrode is zero during a first phase of the AC signal transition and negatively offset during a second phase of the AC signal transition. In another exemplary embodiment, during pre-charging an electrical potential of the fluid reservoir is initialized at an electrical potential that is offset relative to that of the reference electrode, wherein upon AC signal transition of the actuation voltage a potential difference between the liquid droplet and reference electrode has a positive offset value during a first phase of the AC signal transition and a negative offset value during a second phase of the AC signal transition.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

Advantageous Effects of the Invention

The inventors have realized that the potential disadvantages of conventional configurations above can be negated by pre-charging the input fluid reservoir to a DC potential $V_0$ on input. A suitable value of $V_0$ may be selected such that the resultant potential of the top substrate electrode typically ensures that the DC potential between the top substrate electrode and liquid fluid reservoir is zero, or close to zero, and the electro-wetting voltage is maximized. The device further is configured such that the droplets have no electrical connection to the DC potential when in the fluid gap away from the input fluid reservoir. By pre-charging the input fluid reservoir to a suitable $V_0$, deviations of the DC offset of the droplets from a desirable are minimized, and thus the actuation voltage is optimized, which avoids the deleterious effects described above.

BRIEF DESCRIPTION OF DRAWINGS

In the annexed drawings, like references indicate like parts or features:

FIG. 5 sets forth a set of equations describing electrical properties associated with a typical droplet actuation operation.

DESCRIPTION OF EMBODIMENTS

Figure 1:
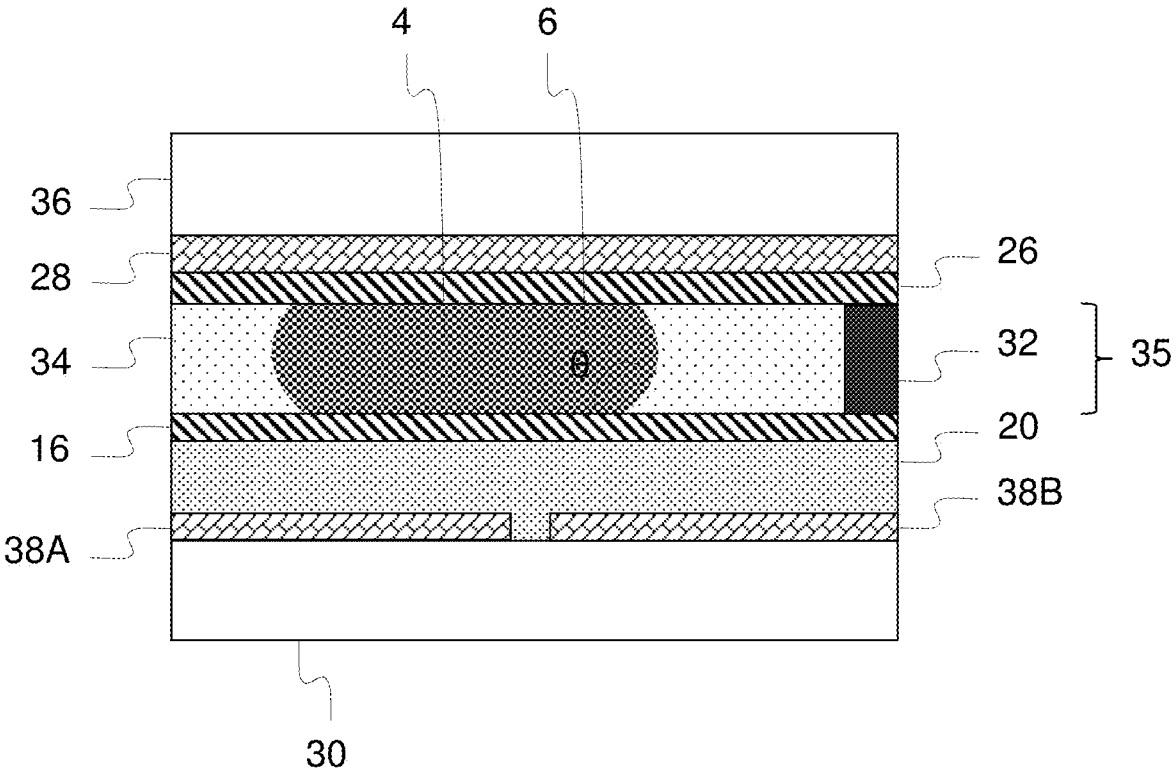
FIG. 1 is a drawing depicting a schematic cross-sectional diagram of a conventional EWOD device.

Embodiments of the present invention will now be described with reference to the drawings, wherein like reference numerals are used to refer to like elements throughout. It will be understood that the figures are not necessarily to scale.

Figure 2:
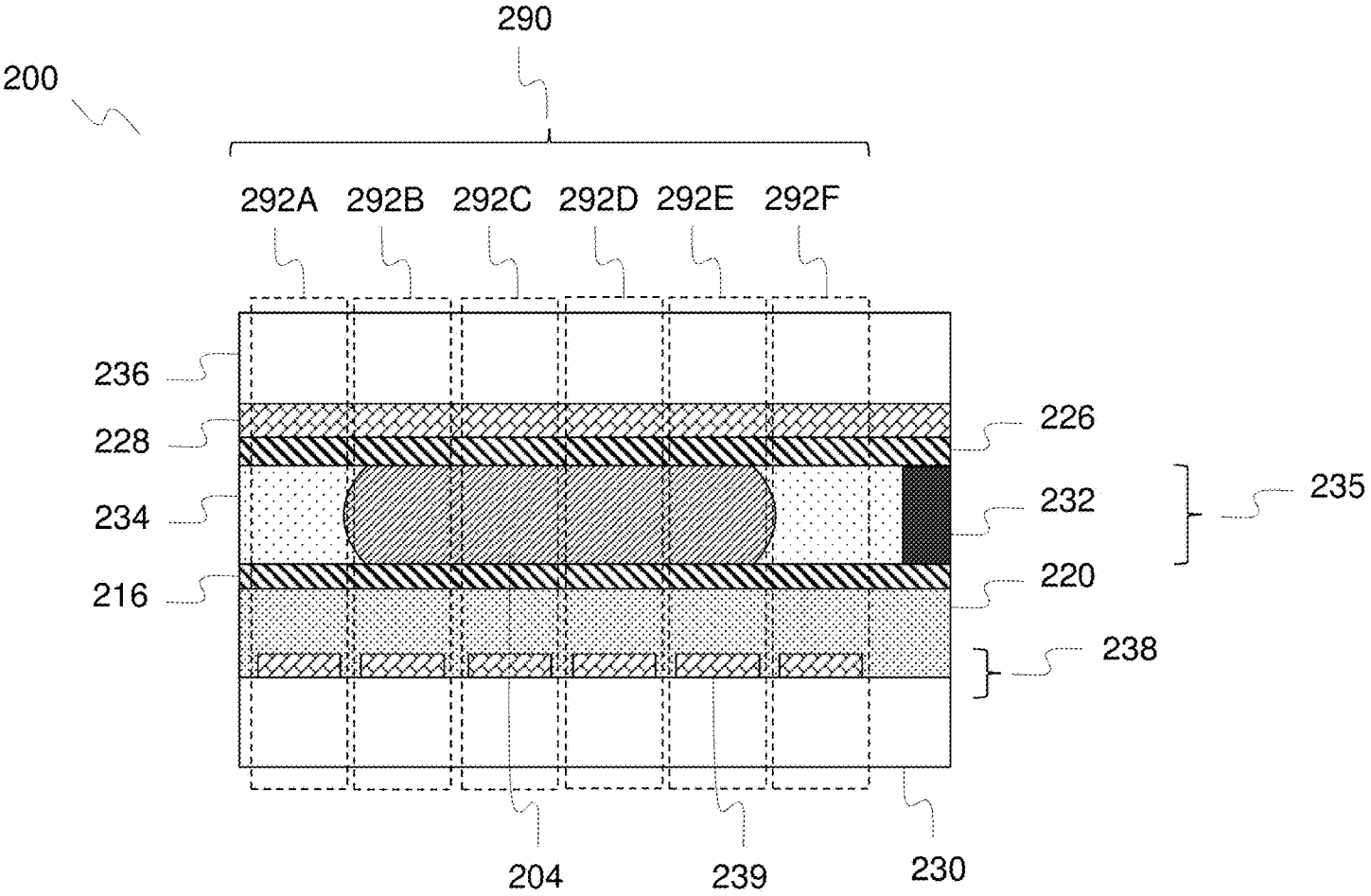
FIG. 2 is a drawing depicting a conventional structure for an EWOD device.
Figure 2B:
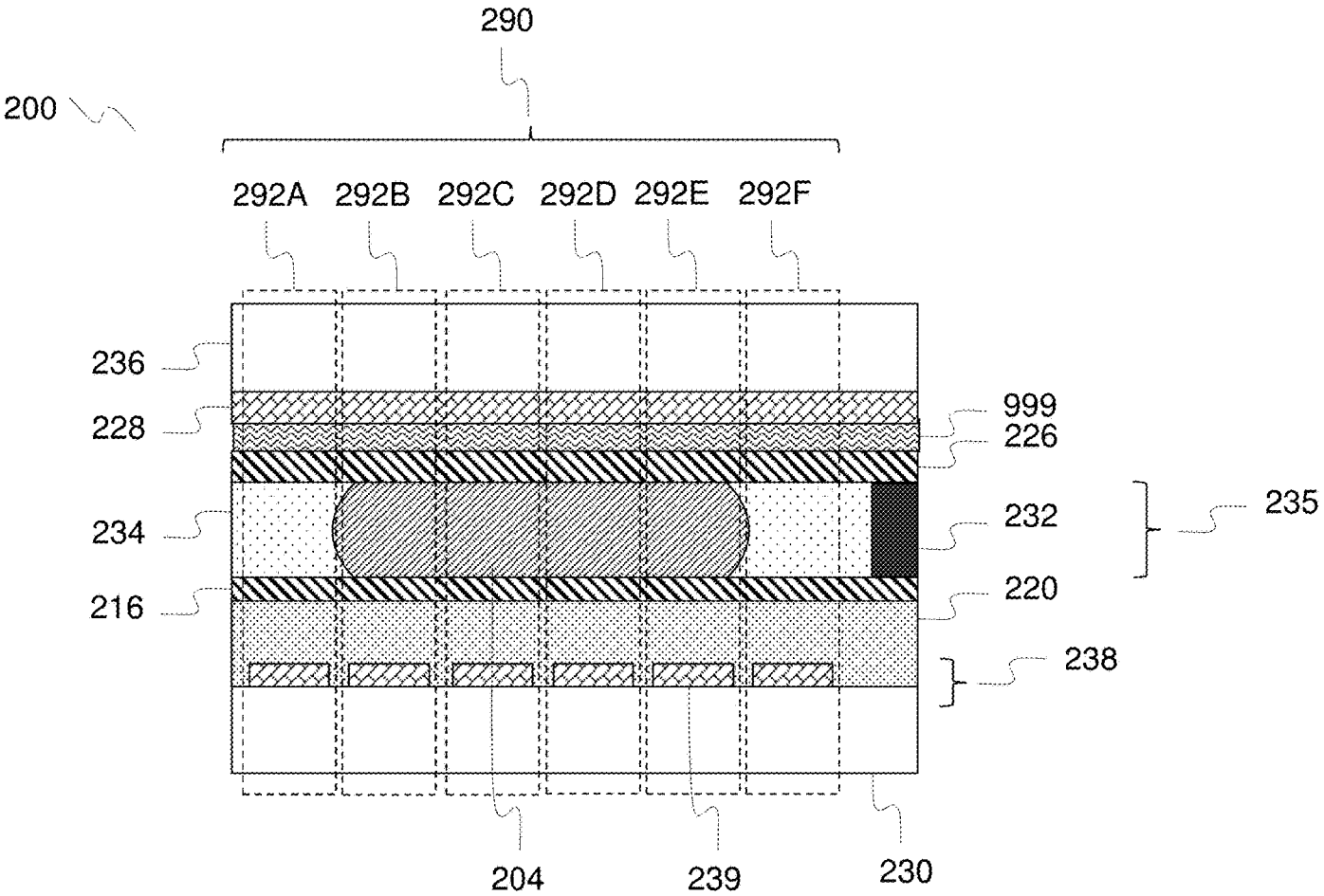
FIG. 2B is a drawing depicting another conventional structure for an EWOD device having an additional insulating layer.

The structure of an exemplary EWOD device 200 is shown in FIG. 2. An exemplary EWOD device may include a first substrate 230, a second substrate 236 and a spacer 232 disposed between the two substrates to form a fluid gap 235. The first substrate 230 includes a set of element electrodes 238, an insulator layer 220 and a first hydrophobic coating layer 216. The second substrate 236 includes a second common reference electrode 228 and a second hydrophobic coating layer 226. Optionally, in this and all embodiments, an additional insulator layer 999 may also be interposed between the electrode 228 and the hydrophobic coating 226 as shown in FIG. 2B.

The fluid gap is filled with a filler fluid 234 and liquid droplets 204 that may be manipulated within the EWOD device. The EWOD device 200 may include an array of elements 290, such as elements 292A-292F. Each element 292A-F of the array of elements 290 may include an element electrode 239 from the set of element electrodes 238, and a portion of the second common reference electrode 228. A liquid droplet 204 may occupy the fluid gap corresponding to a subset of elements 292A-F in the array of elements, for example elements 292B to 292E in the example case of FIG. 2.

The first substrate 230 and second substrate 236 may be made of a transparent insulating material, such as glass. The conductive material used to form the element electrodes 239 of the set of element electrodes 238 and second electrode common reference electrode 228 may be a transparent conductor such as Indium Tin Oxide (ITO). The insulator layer 220 may be an inorganic insulator such as silicon nitride or silicon dioxide. Layers and structures may be formed on the substrates using standard manufacturing techniques, such as photolithography, common in for example, the LCD industry. The hydrophobic material of hydrophobic layers 216 and 226 may be a fluoropolymer. The filler fluid 234 may be a non-polar material such as oil. The liquid droplet 204 may be an aqueous and/or ionic fluid. The conductivity of the liquid droplet 204 may be substantially higher than that of the filler fluid 234.

Figure 3:
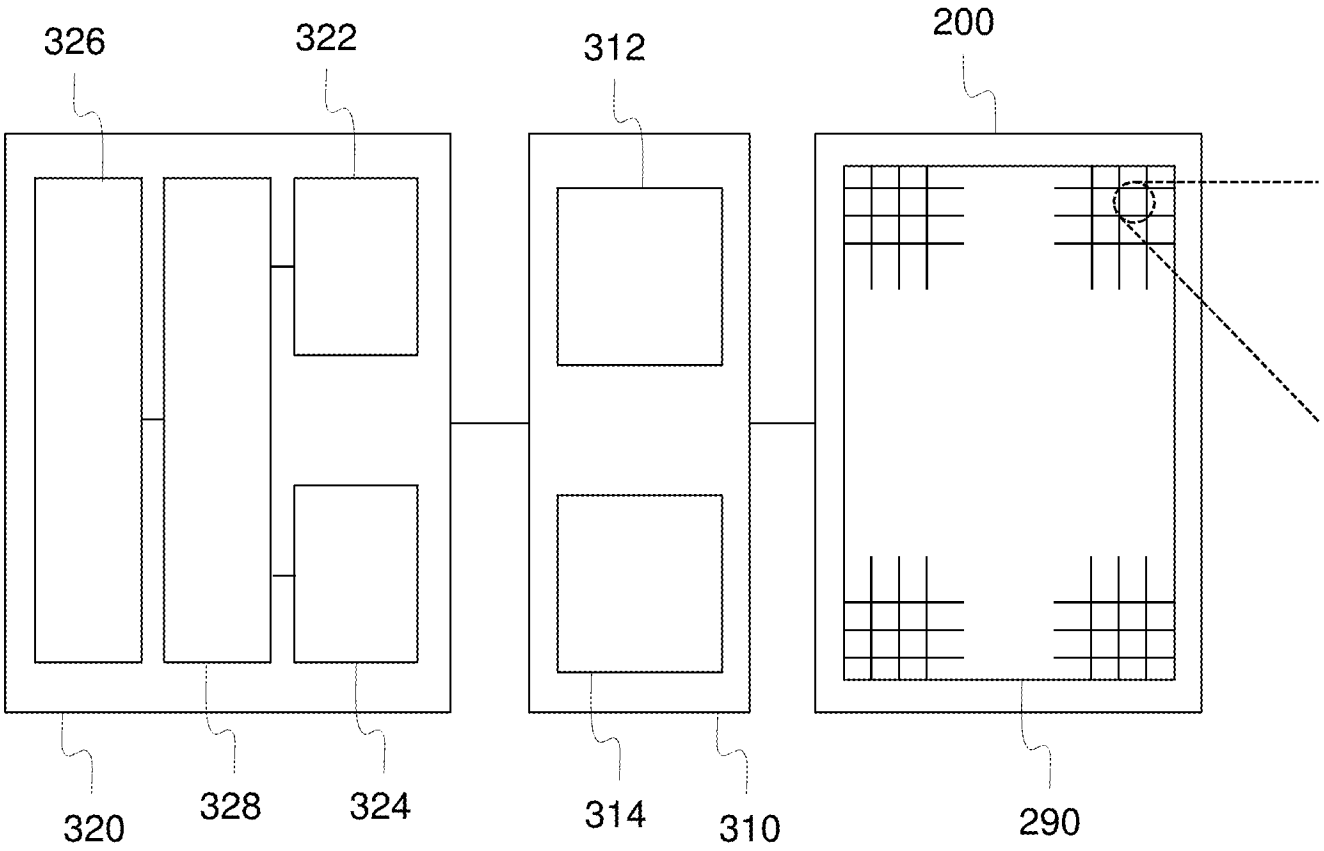
FIG. 3 is a drawing depicting an exemplary EWOD device and controller system.

As shown in FIG. 3, the EWOD device of FIG. 2 may be used as part of a microfluidic system in conjunction with a hardware controller 310 and a processing unit 320. The hardware controller unit 310 includes a signal generator unit 312 to generate the voltage signals applied to each element electrode 239 in the set of element electrodes 238. In a preferred embodiment, circuits within the EWOD device—for example integrated on the first substrate 230 using thin film transistors—may decode the voltage signals supplied by the signal generator unit and generate the voltage signals applied to each element electrode 239 in the set of element electrodes 238. Such circuits are well-known, for example as described in U.S. Pat. No. 8,653,832 (Hadwen et al, issued Feb. 18, 2014). Alternatively, as is well-known in the art, the signal generator unit 312 may apply the voltage signals directly to the element electrodes.

In exemplary embodiments, the hardware controller unit 310 optionally also may include a droplet position detector 314 to detect the position, size and shape of liquid droplets 204 on the array of elements 290. In a preferred embodiment, circuits within each element 292 of the array of elements 290 of the EWOD device 200 may be used to measure the capacitance between an element electrode 239 and the second common reference electrode 228. Such circuits are well-known, for example as described in U.S. Pat. No. 8,653,832 (Hadwen et al, issued Feb. 18, 2014). In such an arrangement, the droplet position detector 314 may generate the signals to control the operation of said sensing circuit and process the signals generated by the sensing circuit to produce a map of the position, size and shape of the liquid droplets 204 across the array of elements. Alternatively, as is known in the art, the droplet position detector 314 may directly measure the capacitance of each element in the array of elements. Alternatively, as is known in the art, the droplet position detector 314 may be an optical imaging system and include an image processor to produce a map of the liquid droplet positions across the array of elements.

The processing unit 320 includes a pattern generator unit 322, a sensor data analysis unit 324, a memory unit 326 (i.e., a non-transitory computer readable medium) and an operation scheduler 328. The pattern generator unit 322 generates a map of elements in the array to be actuated, the actuation pattern, during one particular cycle of operation of the EWOD device. The pattern generator unit 322 is in communication with the signal generator unit 312 which converts the actuation pattern into voltage signals as described above. In embodiments including the position detector 314, the sensor data analysis unit 324 is in communication with the droplet position detector 314 and processes the map produced by the droplet position detector in order to identify and track individual liquid droplets 204 on the EWOD device 200. The memory unit 326 stores sequences of actuation patterns that define how to perform fluid operations, i.e. manipulations of the liquid droplets 204 on the EWOD device 200 to achieve a desired effect. The memory unit 326 further stores said actuation patterns for a range of distinct fluid operations in a library of fluid operations. Further still, the memory unit 326 also stores a predefined set of fluid operations to be performed on the EWOD device in order to perform a desired fluid protocol. The operation scheduler 328 executes the desired fluid protocol by monitoring the state of the sensor droplet analysis unit 324, and controlling pattern generator unit 322 to generate actuation patterns based on the sequences of actuation patterns, the library of fluid operations and the set of fluid operations stored in the memory unit 326.

Electrical modeling of an exemplary EWOD device is described in detail in Applicant's co-pending application Ser. No. 15/478,752 filed on Apr. 4, 2017, which is incorporated here by reference in its entirely. Details of such electrical modeling include the following.

Figure 4:
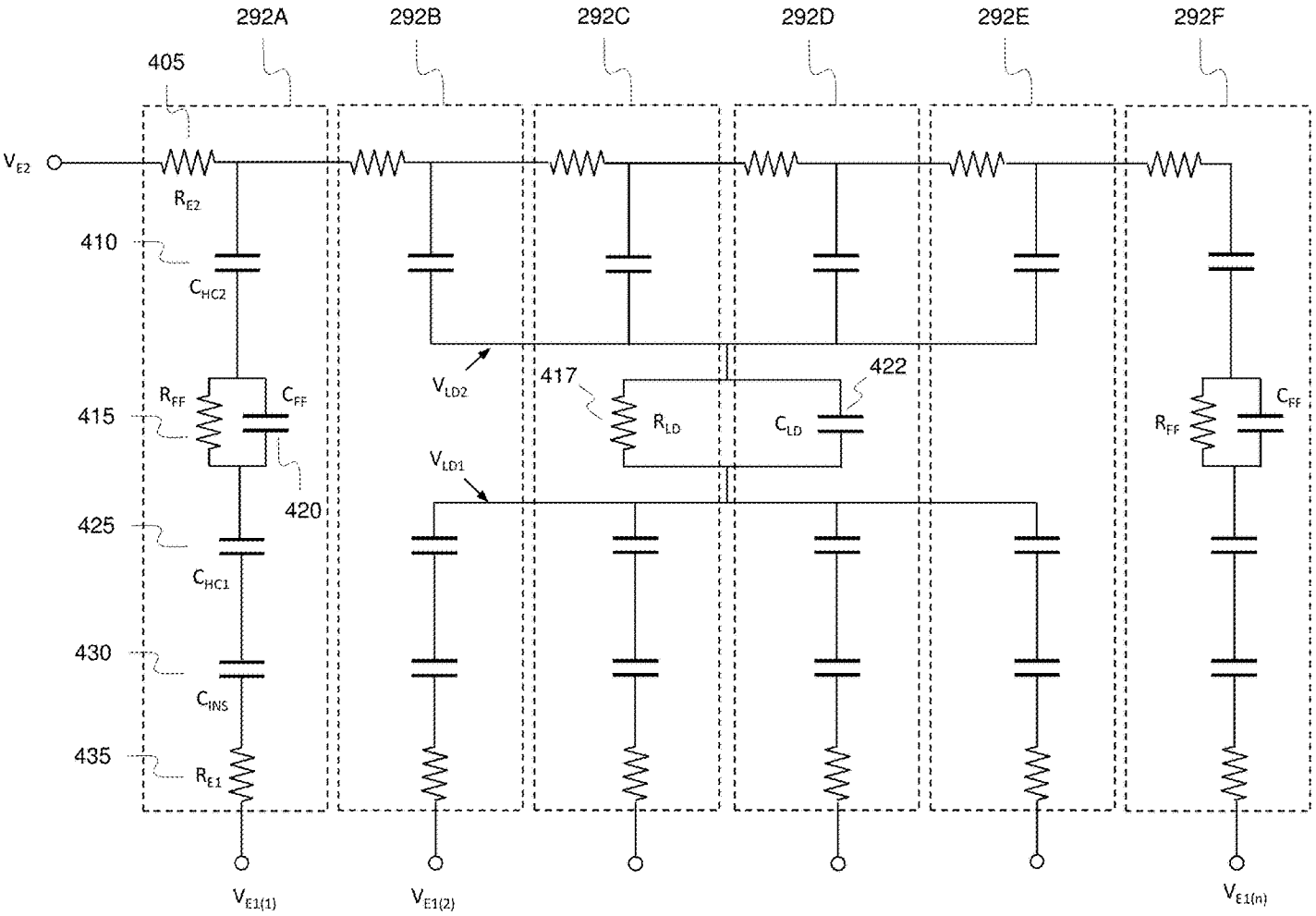
FIG. 4 is a drawing depicting an exemplary electrical model of an EWOD device.

FIG. 4 shows an electrical circuit model of the EWOD device 200 for the example case shown in FIG. 2. Each element 292A-F of the array of elements comprises:

a resistor $RE_2$ 405 representing the resistance of the second common reference electrode 280;

a capacitor $C_{HC2}$ 410 representing the capacitance of the second hydrophobic coating layer 226 (or the second hydrophobic layer 226 in series with the additional insulator 999, in the case where the latter is present);

a capacitor $C_{HC1}$ 425 representing the capacitance of the first hydrophobic coating layer 216;

a capacitor $C_{INS}$ 430 representing the capacitance of the insulator layer 220; and a resistor $RE_1$ 435 representing the resistance of an element electrode 239.

Those elements in the subset of elements corresponding to the location of the liquid droplet 204 additionally comprise a resistor $R_{LD}$ 417 and a capacitor $C_{LD}$ 422 representing the resistance and capacitance of the liquid droplet 204 respectively. The number of elements in the subset of elements corresponding to the location of the liquid droplet 204 is denoted by n. Those elements not corresponding to the location of a liquid droplet additionally comprise a resistor $R_{FF}$ 415 and a capacitor $C_{FF}$ 420 representing the resistance and capacitance of the filler fluid 234 respectively. The voltage of the liquid droplet at the surface of the first hydrophobic coating layer is denoted by $V_{LD1}$. The voltage of the liquid droplet at the surface of the second hydrophobic coating layer is denoted by $V_{LD2}$. Under typical operating conditions, the conductivity of the droplet is such that the voltages $V_{LD1}$ and $V_{LD2}$ may be assumed to be equal and denoted by $V_{LD}$. The actuation voltage, $V_{ACT}$, is defined as the potential difference between the liquid droplet 204 and an element electrode 239, i.e. $V_{ACT}=V_{LD}-V_{E1(n)}$. For droplet actuation using the electrowetting technique, the magnitude of the electrowetting actuation voltage (abbreviated in what follows as the electrowetting voltage) must be greater than the magnitude of the electrowetting threshold voltage, $V_{EW}$, i.e. $|V_{ACT}|>|V_{EW}|$.

In the region of a liquid droplet 204, the potential difference across the second hydrophobic coating layer 226 (or series combination of the second hydrophobic layer and additional insulator 999, in the case where the latter is present), $\Delta V_{HC2}$ is related to the voltages applied to the corresponding element electrodes 239, the voltage applied to the second common reference electrode 228, and the capacitance of the capacitors formed within each element 292 of the array of elements 290. $\Delta V_{HC2}$ is characterized by the set of equations given in FIG. 5. Symbols in the set of equations correspond to the above description with $V_0$ being an initial potential of the liquid droplet. The potential difference across the second hydrophobic coating layer, $\Delta V_{HC2}$, is therefore based on the initial potential of the liquid droplet $V_0$ and the sum of the voltages, $V_{E1(n)}$, applied to the subset of element electrodes 239 of the set of first electrodes 238 corresponding to the region of the liquid droplet.

Figure 6:
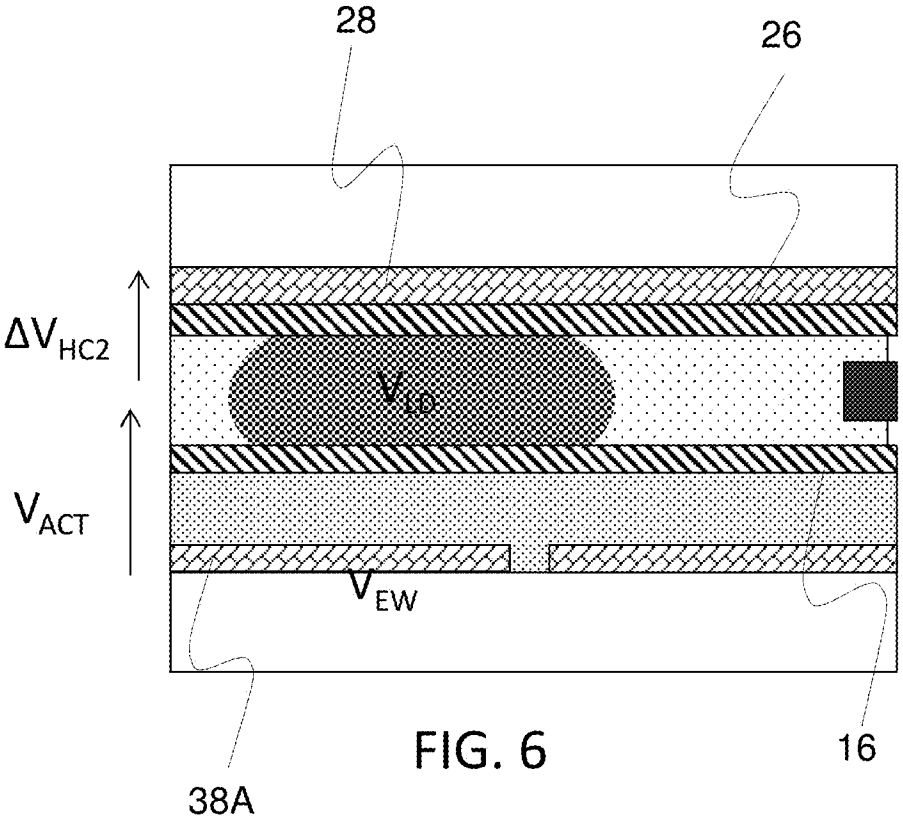
FIG. 6 is a drawing depicting an exemplary EWOD device and denoting pertinent voltage parameters related to device operation.

It is the object of this invention to provide a device configuration and control methods to set the DC offset or initial droplet potential, $V_0$, of the input fluid reservoir to a suitable predetermined amount. In exemplary embodiments, the DC offset of the liquid reservoir, $V_0$, is preset essentially such that the potential difference across the second hydrophobic coating layer, $\Delta V_{HC2}$ is essentially zero. This situation is characterized in FIG. 6 which sets forth the liquid droplet voltage $V_{LD}$ and the electrowetting voltage at the actuation electrodes, $V_{EW}$, along with the actuation voltage $V_{ACT}$ and the potential difference across the second hydrophobic coating layer, $\Delta V_{HC2}$. With the DC offset voltage $V_0$ preset in accordance with principles of the present invention, $V_{ACT}$ [$=(V_{EW}-V_{LD})$] is approximately $V_{EW}$, and $\Delta V_{HC2}$ is approximately 0V. In the depiction of FIG. 6, the device components are only partially labeled for convenience of illustration.

In conventional devices, the quality of the hydrophobic coatings 16 and 26 can often be inferior. In such situations, there can be electrical "leakage" particularly between the top hydrophobic coating 26 and the reference electrode 28. Such leakage may be variable and can undermine the actuation voltage, rendering the droplet manipulations variable, less effective and harder to perform reliably and reproducibly. In addition, there may be defective points in which electrical discharge releases the actuation potential, resulting in areas on the device of sticking or pinning of the droplets in which droplet manipulations can no longer be performed. This electrical discharge can also form bubbles which further undermines device performance.

Accordingly, it is highly desirable to use high quality hydrophobic coatings 16 and 26. In such case, however, the hydrophobic coatings are essentially fully insulative layers, and thus act as pure capacitors with no electrical connection (i.e., no leakage) relative to the top electrode 28. In conventional configurations using high quality hydrophobic coatings, the potential of the liquid droplet $V_{LD}$ tends to "float", and thus can vary arbitrarily. As referenced above, generally $V_{ACT}$ [$=(V_{EW}-V_{LD})$]. Accordingly, if the floating $V_{LD}$ moves closer to the electrowetting voltage $V_{EW}$ applied to the electrodes 38A than is desirable, the actuation voltage decreases and droplet manipulations are undermined. If, on the other hand, $V_{LD}$ moves father from the electrowetting voltage $V_{EW}$ applied to the electrodes 38A than is desirable, an excessive actuation voltage results which can damage the device layers. A catastrophic device failure can even occur and has been observed by the inventors. Similar deficiencies can occur by the floating $V_{LD}$ affecting the potential difference across the second hydrophobic coating layer, $\Delta V_{HC2}$. It is desirable that $\Delta V_{HC2}$ be small and preferably zero, and if the floating $V_{LD}$ results in a non-zero $\Delta V_{HC2}$, sluggish droplet manipulations can occur particularly on input of the droplet. If this occurs, the droplets can fail to dispense properly.

The top plate hydrophobic coating functions substantially as an insulator layer (when made to a high quality). Accordingly, electrically this top plate hydrophobic coating layer can be modelled as a capacitor in parallel with a resistance. The capacitance per unit area is a function of the thickness and the electrical permittivity of the material. The resistance is principally determined by the quality of the layer and may be in the range $10^6$-$10^{12}$ ohms or higher if the layer is well constructed. In the option where an additional insulator layer is included between the top plate hydrophobic coating and the top plate electrode, the combination of this insulator and the hydrophobic coating will have an impedance that is even more like a pure capacitor, with a very low DC conductivity.

For the time constants of concern for device operation, this resistance may be effectively modeled as infinite, and thus for practical purposes the top plate hydrophobic coating layer functions as a pure capacitor. This being the case, the droplet is therefore at a floating potential in the device.

In view of the above, it is therefore desirable to configure the device to preset the DC offset voltage $V_0$ of the initial fluid reservoir from which droplets are generated (or the fluid reservoir in its entirely may be manipulated as a droplet itself) to meet the criteria of (1) $V_{ACT}$ [$=(V_{EW}-V_{LD})$] is approximately $V_{EW}$, and (2) $\Delta V_{HC2}$ is approximately 0V. To accomplish such a result, an input reservoir used to form the droplets (or that subsequently is manipulated as the droplet) is pre-charged to have a specified or preset DC potential ($V_0$) at a point of entry of the aqueous liquid into the EWOD device cartridge. In particular, a generalized feature of the various embodiments is that the input fluid reservoir is pre-charged by exposing the input fluid reservoir to a portion of the electrode arrangement upon entry into the input structure of the EWOD device. The specified or preset DC potential is preferably selected to minimize an average voltage across the top substrate layer. The inventors have realized that the potential disadvantages of conventional configurations can be negated by pre-grounding or pre-charging the fluid reservoir to a DC potential on input. Upon splitting droplets from the input reservoir, or moving the input reservoir from the input structure to form the droplet, the droplet then is removed from contact with the electrode portion and allowed to be at a floating potential. Because the input reservoir has been pre-charged, the floating potential away from the input structure tends to remain within a desirable range.

With such a configuration, the present invention solves the problems above provided the DC droplet potential $V_0$ is well chosen. In exemplary embodiments, a suitable value of $V_0$ may be selected such that the resultant potential of the top substrate electrode typically ensures that the DC potential between the top substrate electrode and liquid droplet is zero, or close to zero, and the electro-wetting voltage is maximized. In the conventional configurations described in the background section above (see, e.g., particularly U.S. Pat. Nos. 923,822 and 9,011,662), it is taught to improve performance specifically by having the droplets remain in continuous contact or frequent contact with a ground or reference electrode. The present invention operates differently, whereby the device is configured such that the droplets have no electrical connection to a DC potential when in the fluid gap, as is generally preferable for reasons previously explained. The present invention further has a configuration that sets the DC potential at a specified or preset initialization state when the fluid reservoir is in a fluid input structure. $V_0$ is thus set at a chosen suitable initial potential. Once the droplet is detached from the fluid input structure, such as for example by moving a droplet away from the fluid input structure by dispensing/splitting a droplet out of the input fluid reservoir, the droplet is at a floating DC potential.

In accordance with such features, an electrowetting on dielectric (EWOD) device includes a first (e.g., top) substrate and an opposing second (e.g., bottom) substrate defining a gap between the first and second substrates, each substrate including an insulating surface facing the gap. The EWOD device includes an array of elements having a plurality of individual elements that are actuatable for manipulation of a liquid droplet within the gap, each individual element including a plurality of electrode elements to which actuation voltages are applied. A pre-charging structure includes a channel in fluid communication with the gap and that is configured to receive a fluid reservoir for generation of the liquid droplet, and the pre-charging structure includes an electrical element electrically exposed to the channel. The electrical element pre-charges the fluid reservoir within the channel, and a portion of the gap containing the liquid droplet spaced apart from the channel is electrically isolated from the electrical element such that the liquid droplet is at a floating electrical potential when located within said portion of the gap. The pre-charging structure may be configured as an input structure defining an input channel in fluid communication with the gap, wherein the input channel is the channel that is configured to receive the input of the fluid reservoir, and the electrical element comprises an electrode portion of the plurality of electrode elements that is exposed to the input channel.

Figure 7A:
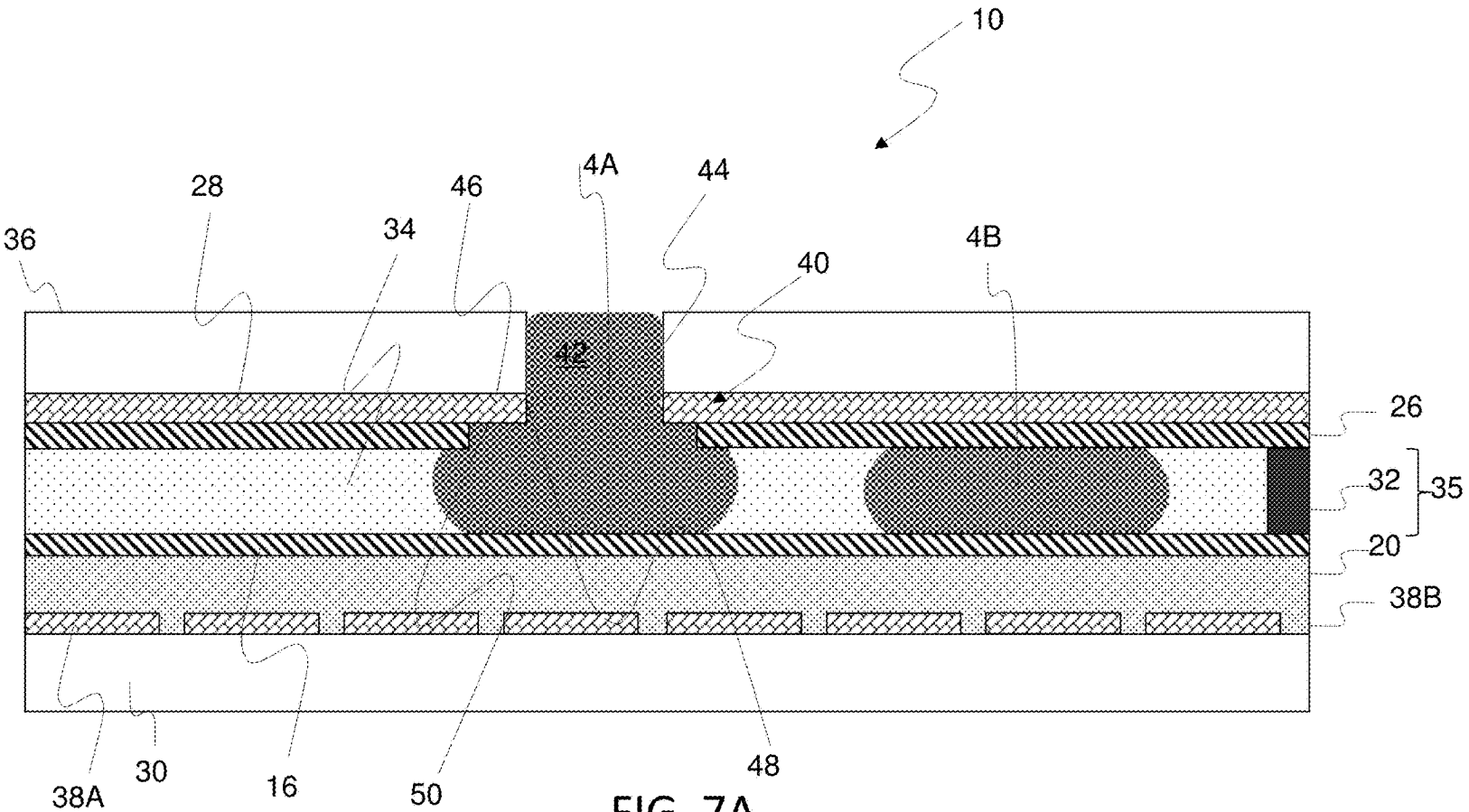
FIG. 7A is a drawing depicting an exemplary EWOD device in accordance with a first embodiment of the present invention.

FIG. 7A is a drawing depicting an exemplary EWOD device 10 in accordance with a first embodiment of the present invention. The EWOD device 10 has a portion of components comparable as in the conventional device of FIG. 1, and thus like reference numerals are used to identify like components. The EWOD device 10 includes a fluid input structure 40 that defines an input channel 42 for input of a fluid reservoir 4A. To form the input channel 42, the fluid input structure 40 includes an opening 44 cut away in the top substrate 36 through which the liquid reservoir 4A may be inputted by any suitable external means (e.g. a pipette, from a fluidic chamber, from another microfluidic device, or the like).

In general, the fluid input structure 40 includes an electrode portion 46, which in this embodiment is a portion of the reference electrode 28. The electrode portion 46 is exposed to the input channel 42, i.e., there is no layer or component between the electrode portion 46 and the input channel 42. In the region of the exposed electrode portion 46 and input channel 42, the hydrophobic coating 26 may be removed to create a stepped configuration relative to the electrode 28, in which the electrode portion 46 includes a first surface 48 and a second surface 50 that are exposed to the input channel 42. The hydrophobic coating 26 may be removed from the second surface 50 of the electrode 28, for example, by means of lithographic patterning, such as an etch process or lift off process. Alternatively, a method of manufacturing may prevent the hydrophobic coating 26 from attaching to the electrode 28 at the second surface 50 in this region, for example by means of a mechanical barrier which is then removed.

With the configuration of FIG. 7A, the liquid reservoir 4A is in electrical contact with the electrode portion 46, and thus assumes the electrical potential of the electrode 28 which may be set in accordance with the parameters set forth above. In this manner, the liquid reservoir 4A is pre-charged to an initial voltage $V_0$ to achieve the desired parameters described in connection with FIG. 6, that $V_{ACT}$ [$=(V_{EW}-V_{LD})$] is approximately $V_{EW}$, and $\Delta V_{HC2}$ is approximately 0V. Liquid droplets 4B then may be created in the fluid gap 35 away from the input channel 42 either by dispensing (splitting) a droplet 4B from the input reservoir 4A, or by moving en masse the entirety of the reservoir 4A away from the input channel 42 to form the droplet 4B. The DC potential of the droplet 4B $V_0$ will be set by the potential applied to the electrode 28 while in the droplet is part of the reservoir 4A in the input structure 40, and generally tends to remain at this DC offset voltage upon ceasing to have a conductive path to the electrode 28 when the droplet 4B becomes positioned in the fluid gap 35 spaced apart from the input structure 40.

The configuration of FIG. 7A permits the DC offset relative to the top substrate electrode to be approximately 0V, or as close to the optimum level of 0V as is practicable. In other words, the DC potential across the top substrate hydrophobic coating 26 is approximately 0V. This provides high reliability and prevents electrical breakdown of the hydrophobic coating, and otherwise reduces the potential for bubble formation at such layer. In addition, a potential difference between the droplet and the actuating electrode, i.e., the electro-wetting voltage $V_{EW}$, is maximized, which in turn maximizes the electro-wetting force. Improved performance and reliability of the electro-wetting operations (e.g., droplet movement speed, speed of dispensing, reliability of dispensing) thereby are achieved.

Figure 7B:
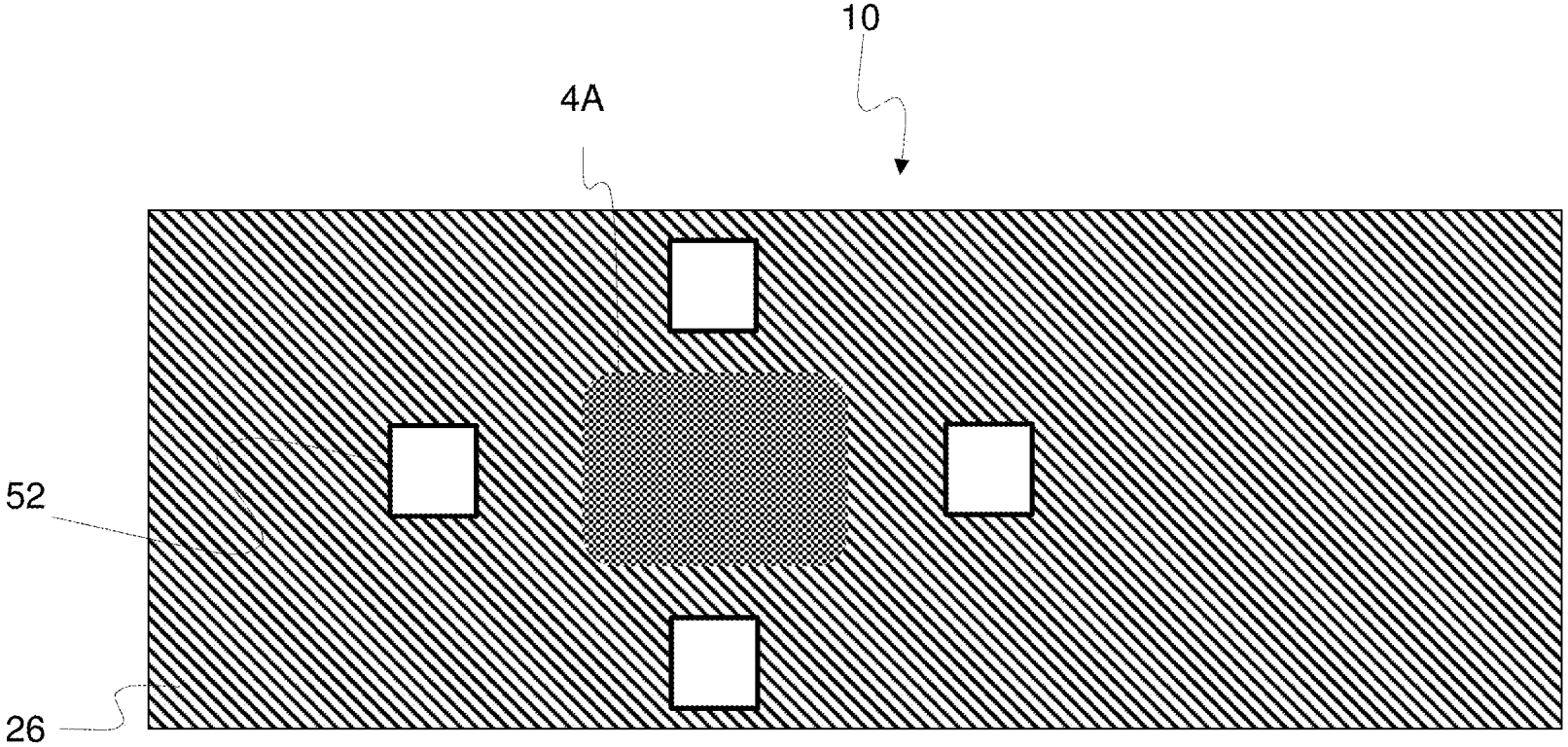
FIG. 7B is a drawing depicting an exemplary EWOD device in accordance with a second embodiment of the present invention.

FIG. 7B is a drawing depicting the exemplary EWOD device 10 in accordance with a second embodiment of the present invention. FIG. 7B is essentially a top plan view with some of the upper layers removed to show the hydrophobic coating 26. FIG. 7B illustrates that multiple DC offset setting structures 52 may be provided spaced apart from the reservoir 4A at the input structure described above. In this manner, a DC offset voltage $V_0$ may be reset at various locations throughout the EWOD device 10 to ensure an adequate DC offset of droplets while in the fluid gap 35 away from the input channel 42. Four DC offset setting structures 52 are shown in FIG. 7B as an example, and any suitable number may be employed as desirable for particular applications. The DC offset setting structures 52 may be large and few in number or small and many in number, and may be created, for example, by a photo-lithographic process. Alternative patterning of the hydrophobic coating to create the offset setting structures 52 may include strip or grid patterns where the hydrophobic coating is removed. Each offset setting structure 52 may be configured with a stepped configuration of the hydrophobic coating relative to the reference electrode, comparable to the configuration of input structure 40 described above.

An advantage of the configuration described by this embodiment is that the offset setting structures 52 may be located slightly displaced from the reservoir 4A (=position of the opening in the top substrate 36). This may be convenient for manufacturing reasons; depending on the manufacturing process used to make the opening in the top substrate 36 it may not be so convenient to remove the hydrophobic coating 26 immediately adjacent to the opening and is therefore preferable to separate the offset setting structure 52 slightly from the reservoir 4A. A further advantage of the configuration of FIG. 7B is that by having four such offsetting structures, located in each direction away from the reservoir 4A, the pre-charging principle may be realized when droplets are dispensed from the reservoir 4A in any direction, e.g. in FIG. 7B, up, down, left or right away from the reservoir 4A, since each dispensed droplet will then come into contact with an offset setting structure.

Figure 8:
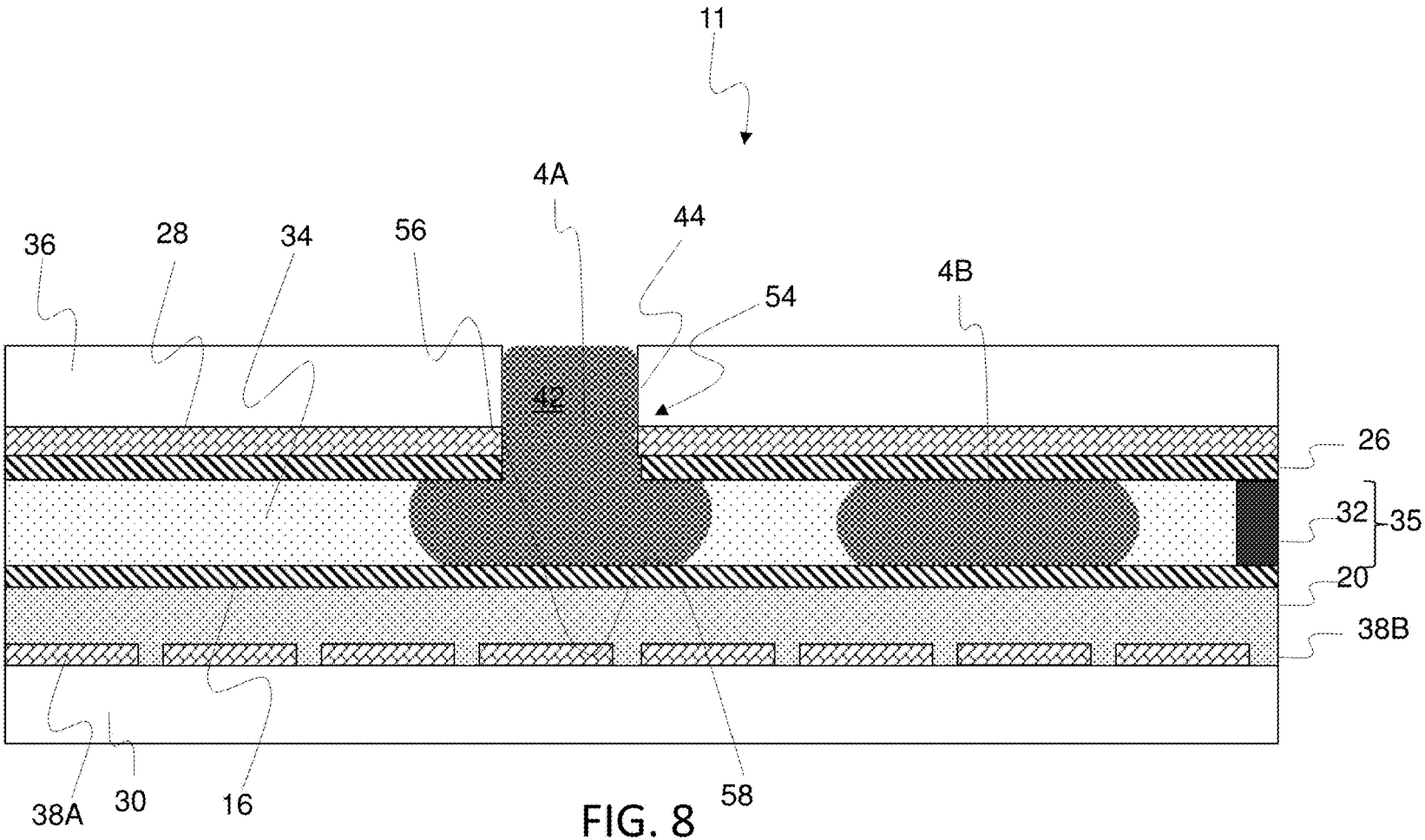
FIG. 8 is a drawing depicting an exemplary EWOD device in accordance with a third embodiment of the present invention.

FIG. 8 is a drawing depicting an exemplary EWOD device 11 in accordance with a third embodiment of the present invention. This embodiment bears similarities to the embodiment of FIG. 7A and operates comparably. Otherwise, relative to the configuration of FIG. 7A, the configuration of FIG. 8 has an alternative configuration of the fluid input structure. In the example of FIG. 8, the fluid input structure 54 has a straight configuration of the hydrophobic layer 26 and electrode 28, rather than the stepped configuration of FIG. 7A. Operation is as described for the first embodiment, with the potential of the reservoir liquid 4A being set to the potential of the top substrate electrode 28 which contacts the liquid in the region of the input channel 42.

In the configuration of FIG. 8, the fluid input structure 54 includes an electrode portion 56, which in this embodiment again is a portion of the reference electrode 28. The electrode portion 56 similarly is exposed to the input channel 42, i.e., there is no layer or component between the electrode portion 56 and the input channel 42. In the region of the exposed electrode portion 56 and input channel 42, the hydrophobic coating 26 may be removed, but in this embodiment has a straight configuration rather than a stepped configuration relative to the electrode 28. Accordingly, the electrode portion 56 of the electrode 28 is exposed only at a single exposed surface 58 that meets the input channel 42. Such a configuration is more straightforward to construct relative to the stepped configuration of FIG. 7A, for there is no need to perform any specialized manufacturing technique for patterning the hydrophobic coating (e.g. by spin coating, printing or evaporation methods of manufacturing the hydrophobic coating). However, the surface area of the exposed electrode portion 56 is reduced relative to the exposed electrode portion 46 having the stepped configuration of FIG. 7A. The configuration of FIG. 8, therefore, can be less effective in setting the initial DC offset voltage of the fluid reservoir 4A. It further will be appreciated that the configuration of FIG. 8 also may be used in combination with multiple DC offset setting structures, as described in connection with FIG. 7B.

Figure 9:
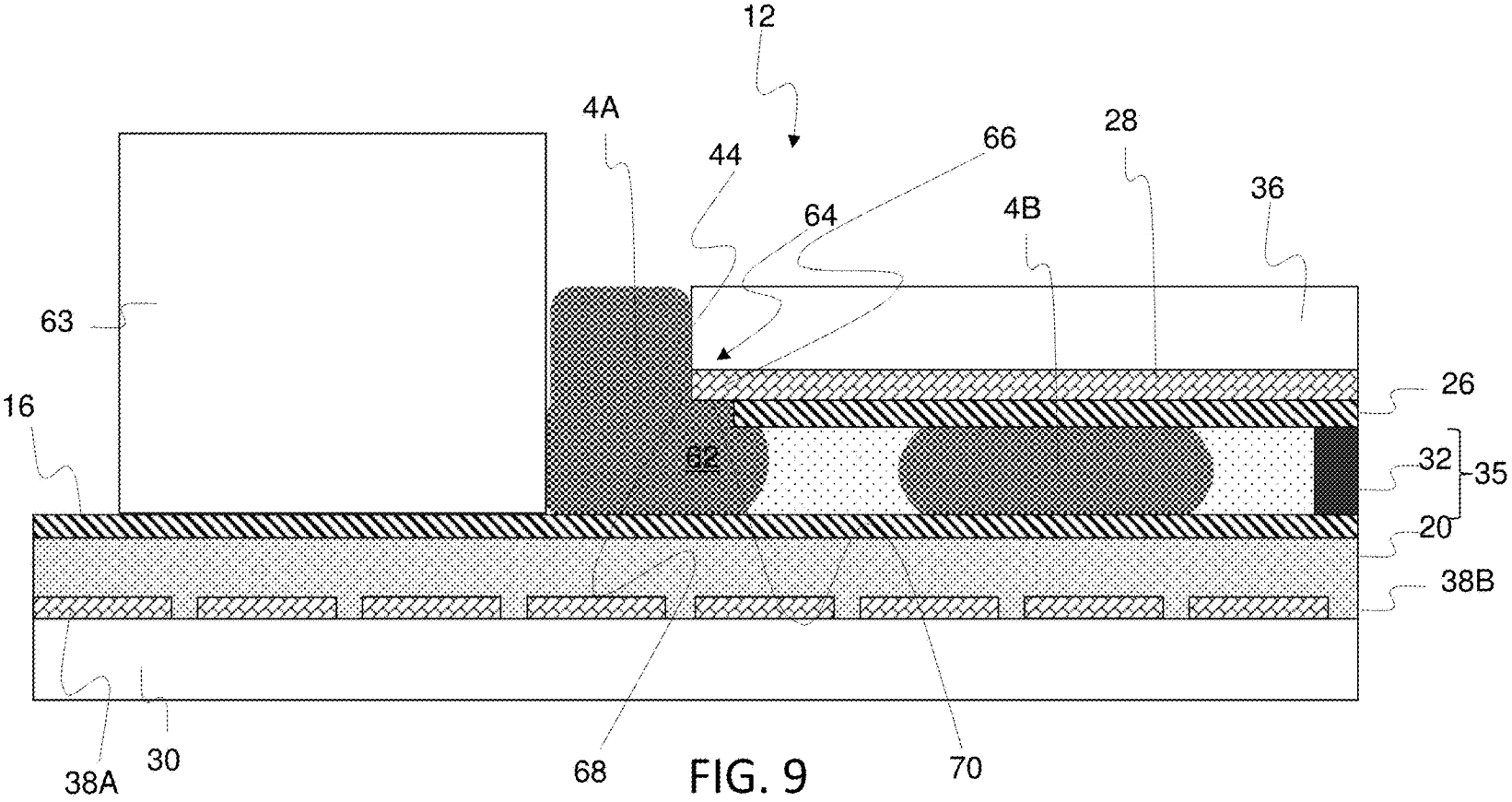
FIG. 9 is a drawing depicting an exemplary EWOD device in accordance with a fourth embodiment of the present invention.

FIG. 9 is a drawing depicting an exemplary EWOD device 12 in accordance with a fourth embodiment of the present invention. This embodiment bears similarities to the previous embodiments and operates comparably. Otherwise, relative to the previous configurations, the configuration of FIG. 9 has an alternative configuration of the fluid input structure. In the example of FIG. 9, the EWOD device has a longitudinal input configuration by which the fluid reservoir 4A supplies fluid droplets 4B through a side opening input channel 62 into the fluid gap 35. For easier input of the fluid, a side support 63 may be employed to support the fluid reservoir 4A as fluid droplets are introduced into the gap. Side input arrangements are known, and can have an advantage in being easier or lower cost to manufacture than forming input channels through the top substrate. Additional details regarding an exemplary side or longitudinal input design are described, for example, in Applicant's application number EP16194632 which is incorporated here by reference.

In the example of FIG. 9, a fluid input structure 64 is formed at the edge of the top substrate 36 and has a stepped configuration of the hydrophobic layer 26 relative to the electrode 28, similar to the stepped configuration of FIG. 7A. Operation is as described for the first embodiment, with the potential of the reservoir liquid 4A being set to the potential of the top substrate electrode 28 which contacts the liquid in the region of the input channel 62. The fluid input structure 64 includes an electrode portion 66, which in this embodiment is a portion of the reference electrode 28. The electrode portion 66 is exposed to the input channel 42, i.e., there is no layer or component between the electrode portion 46 and the input channel 42. In the region of the exposed electrode portion 66 and input channel 62, the hydrophobic coating 26 has been removed to create a stepped configuration relative to the electrode 28, in which the electrode portion 66 includes a first surface 68 and a second surface 70 that are exposed to the input channel 42. As referenced previously, the hydrophobic coating 26 may be removed from the second surface 70 of the electrode 28 by any suitable means, such as for example by lithographic patterning, etching, masking, mechanical barriers, or the like. With the stepped configuration, a larger surface area of the exposed portion of the reference electrode is achieved. It further will be appreciated that the configuration of FIG. 9 also may be used in combination with multiple DC offset setting structures, as described in connection with FIG. 7B. An advantage of this embodiment is that it implements the basic principles of the invention in combination with a side-filling input structure. Since such a structure does not require an opening in the top substrate 36 to be made, this structure may be of lower cost to manufacture.

Figure 9B:
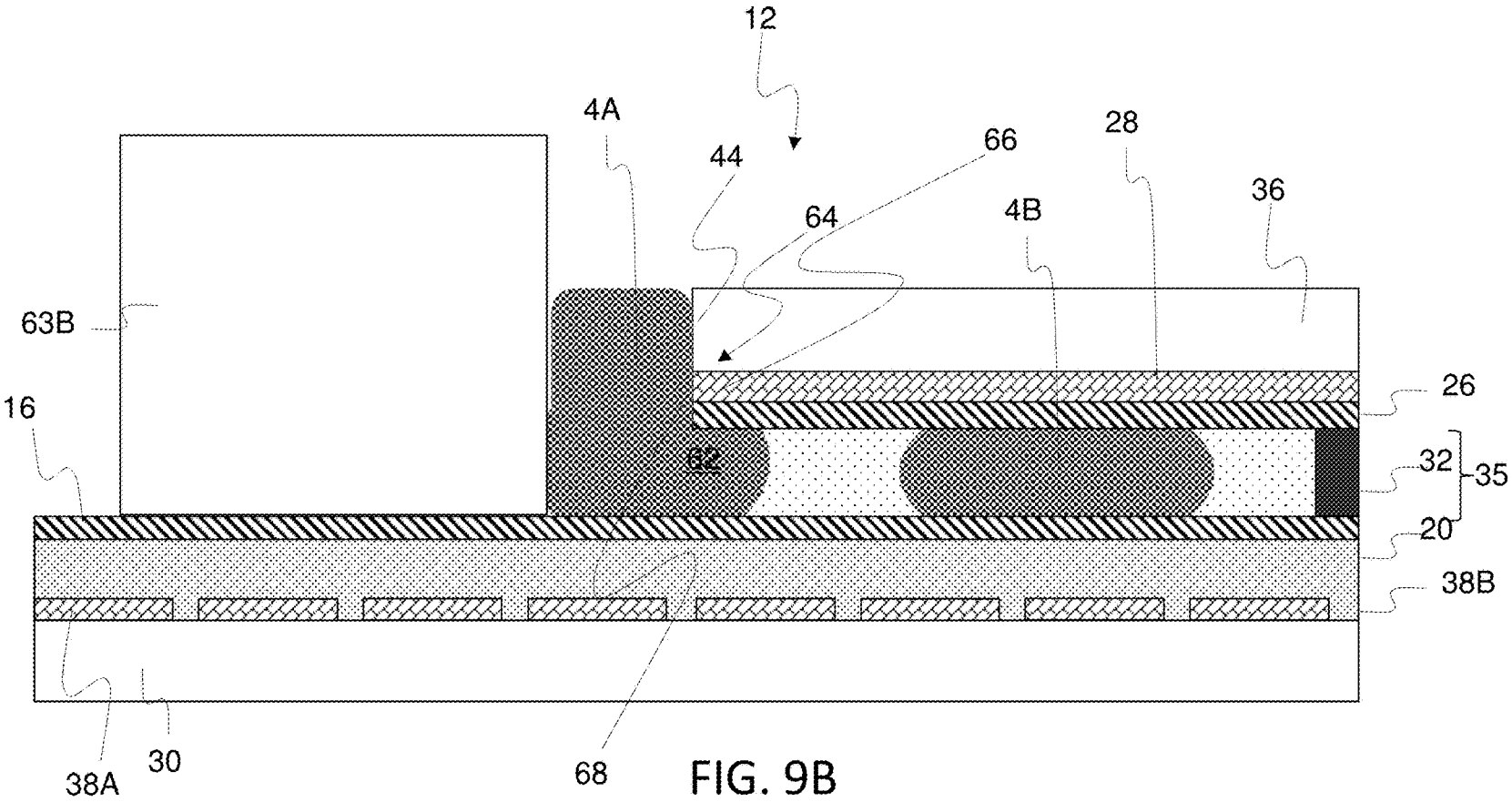
FIG. 9B is a drawing depicting an exemplary EWOD device in accordance with a variation of the fourth embodiment of the present invention.

A variant of this embodiment is shown in FIG. 9B. In this arrangement, the side support structure 63B is conductive and provides the electrical connection to the reservoir liquid 4A. The side support structure 63B could, for example be formed from or coated with a conductive material and connected to an offset potential, which may, for example, be at the same potential as the top substrate electrode 66. In this variant, it is not necessary to remove the hydrophobic coating in the region of the input channel, since the top substrate electrode 66 is not providing the electrical connection to the reservoir liquid 4A.

Figure 10:
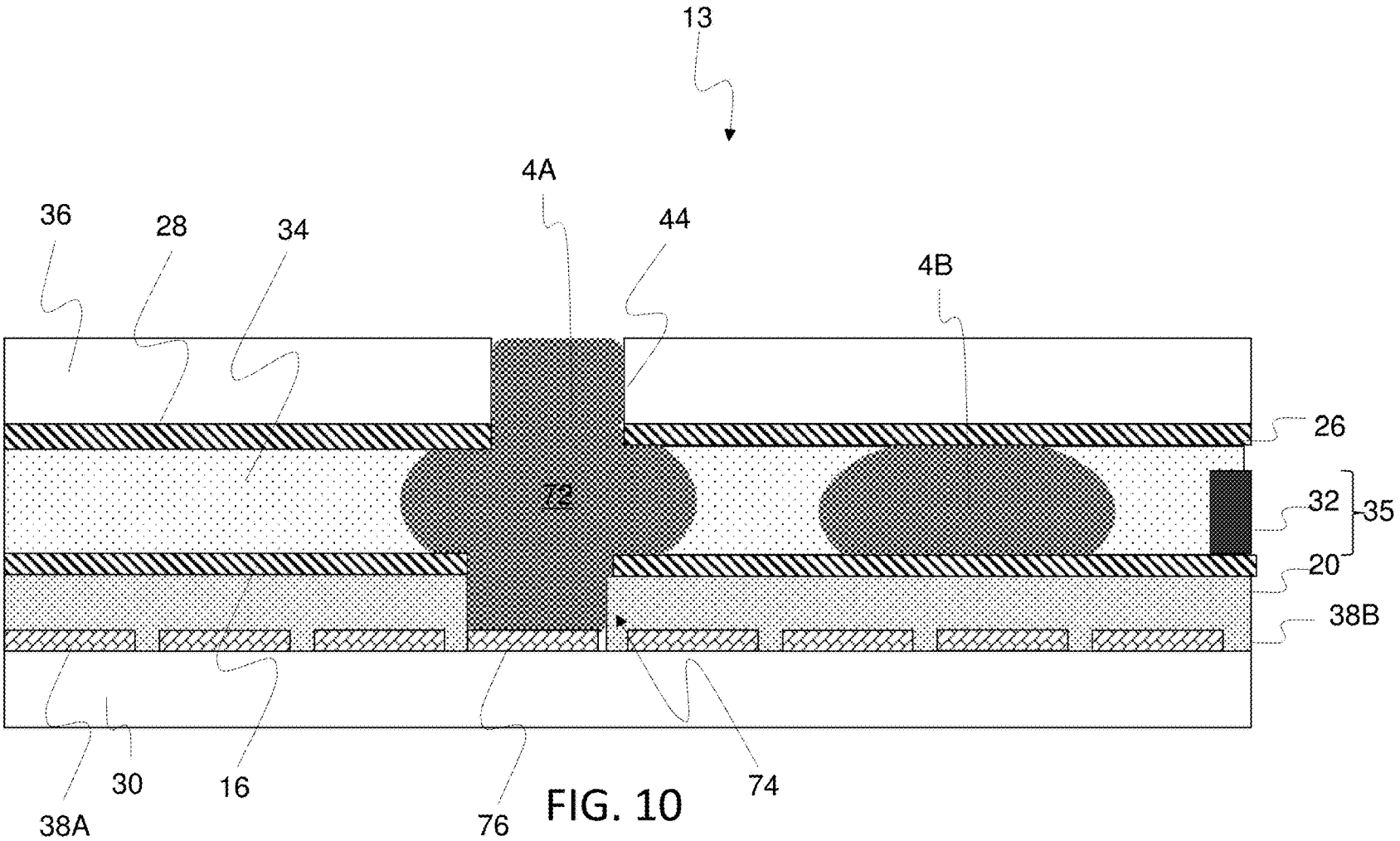
FIG. 10 is a drawing depicting an exemplary EWOD device in accordance with a fifth embodiment of the present invention.

FIG. 10 is a drawing depicting an exemplary EWOD device 13 in accordance with a fifth embodiment of the present invention. This embodiment bears similarities to the previous embodiments and operates comparably in many respects, except the example of FIG. 10 employs an alternative electrode configuration. Specifically, the configuration of FIG. 10 employs a coplanar or inline electrode configuration, in which all the electrode elements are positioned in a coplanar fashion within the electrode array 38B. In other words, there is no additional common reference electrode (e.g., electrode 28) associated with the top substrate that is present in the previous embodiments. Actuation voltages are generated by applying different voltage signals to different electrode elements 38A in the array 38B, with the specific voltages to the different electrodes varying as suitable for the desired droplet operations. Details regarding coplanar or inline electrode configurations are described, for example, in U.S. Pat. No. 7,569,129. Other coplanar or inline configurations also are described, for example, in Applicant's GB1500262.9 which is incorporated here by reference. An advantage of such configurations is that by not requiring the additional electrode, and its associated electrical connections, the overall design of the device is simplified.

Figure 10B:
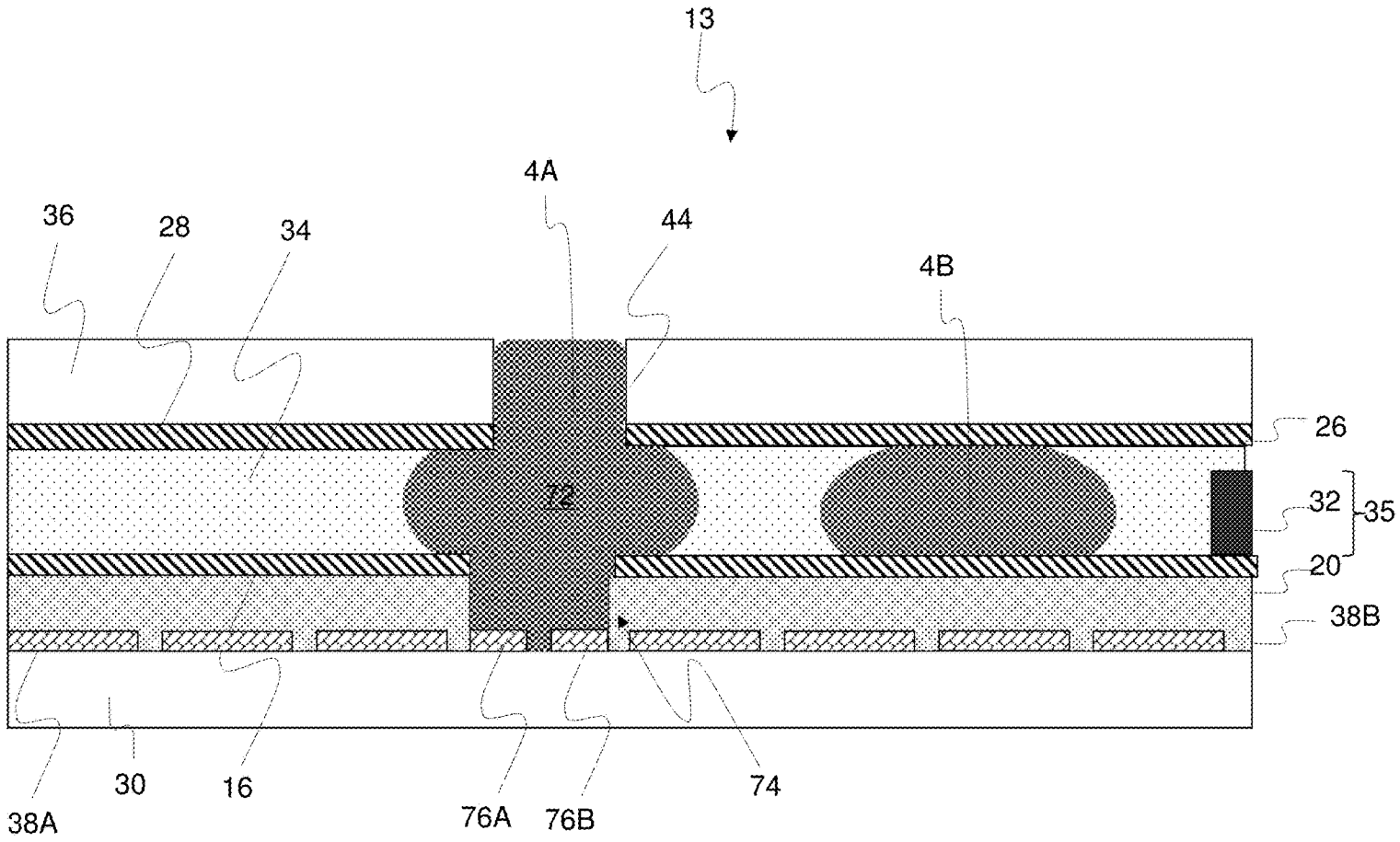
FIG. 10B is a drawing depicting an exemplary EWOD device in accordance with a variation of the fifth embodiment of the present invention.

As referenced above, a generalized feature of the various embodiments is that the input reservoir 4A is pre-charged by exposing the input reservoir to a portion of the electrode arrangement upon entry into the EWOD device. To achieve this with a coplanar or inline electrode arrangement, an input channel 72 into the fluid gap 35 is formed extending through the bottom hydrophobic layer 16 and insulating layer 20 to at least a portion of the electrode layer 38B. In the example of FIG. 10, a fluid input structure 74 includes an electrode portion 76 for pre-charging the fluid reservoir, which in this embodiment is at least a portion of one of the electrode elements 38A within the electrode array 38B. In the example shown, the electrode portion 76 equates to one of the electrode elements 38A, but the electrode portion 76 alternatively can be narrower spanning only a portion of one such element, or can span portions of multiple elements, 76A and 76B as shown in the variant structure FIG. 10B, depending upon the desirable area of exposure for pre-charging the fluid reservoir as suitable for a particular application. The electrode portion 76, similarly to previous embodiments, is exposed to the input channel 72, i.e., there is no layer or component between the electrode portion 76 and the input channel 72, to permit the contact for pre-charging the fluid reservoir 4A. An advantage of this embodiment and the coplanar electrode arrangement is that by removing the requirement for a top substrate electrode (and an associated electrical contact to it) the manufacturing cost of the device is reduced.

Figure 11:
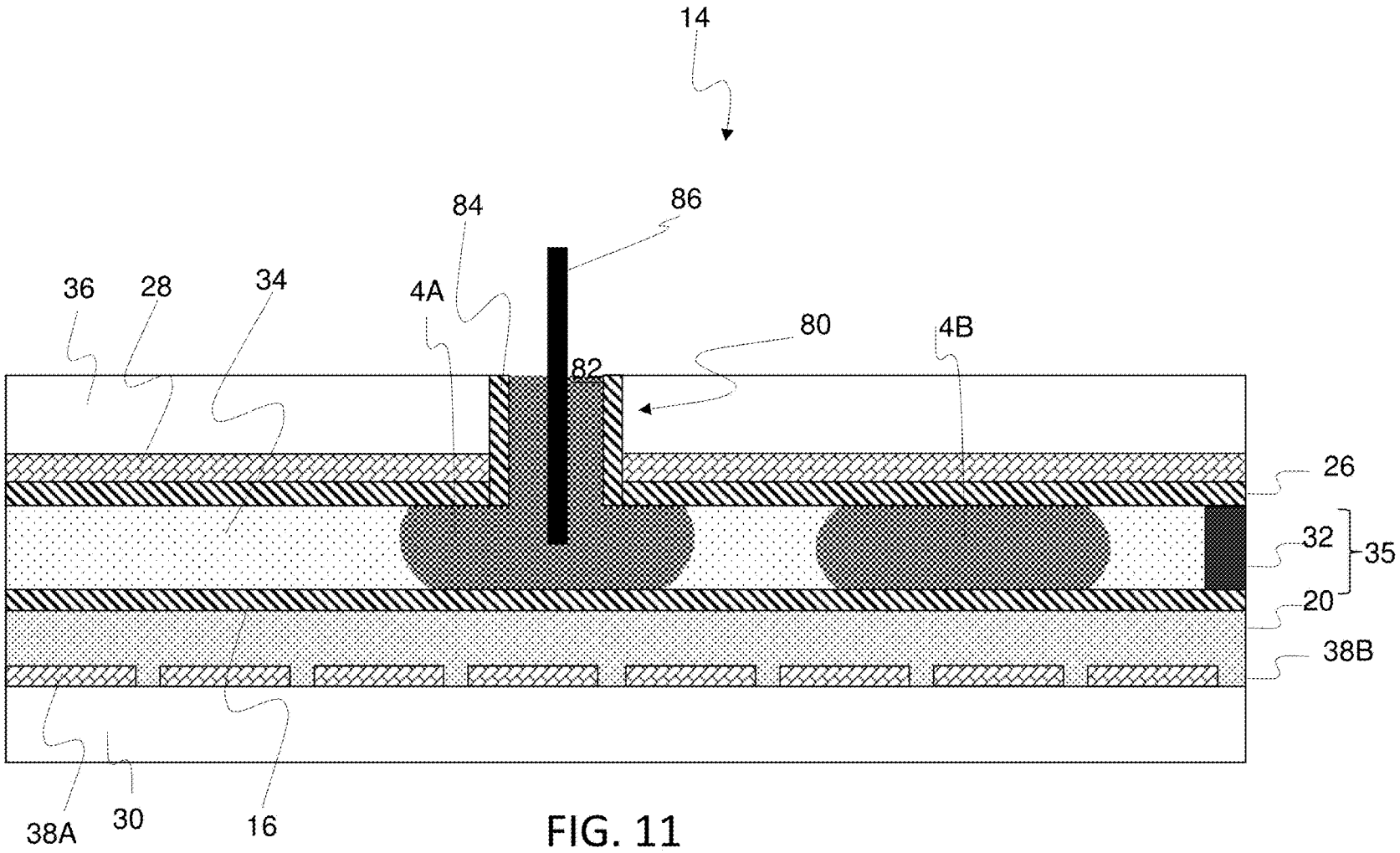
FIG. 11 is a drawing depicting an exemplary EWOD device in accordance with a sixth embodiment of the present invention.

FIG. 11 is a drawing depicting an exemplary EWOD device 14 in accordance with a sixth embodiment of the present invention. This embodiment bears similarities to the previous embodiments and operates comparably in many respects, except the example of FIG. 11 employs an alternative mechanism for pre-charging the droplet reservoir 4A. In the example of FIG. 11, an input structure 80 defines an input channel 82. As part of the input structure 80, in exemplary embodiments the input channel 82 may be defined by an extension 84 of the hydrophobic coating 26. Accordingly, in this embodiment, no portion of the electrode arrangement, including reference electrode 28, is exposed to the liquid reservoir 4A, which differs from the previous embodiments.

For pre-charging the fluid reservoir 4A, the input structure 80 includes a pre-charging element 86. For example, the pre-charging element 86 may be an externally connected grounding structure, such as a grounding wire, that is in contact with the liquid reservoir 4A within the input channel 82. The externally connected grounding structure could be an external structure integrated into a plastic housing surrounding and otherwise housing the EWOD device. In another example configuration, the pre-charging element may be a conductive structure (wire) extending into the input channel 82 that is connected to the same electrical supply that is connected to the top reference electrode 28. In another example configuration, the pre-charging element may be external to the EWOD device and part of the electronic controller elements (see FIG. 3). In one example of controller implementation, the controller may include a facility for automated pipetting of the liquids to be input into the EWOD device. The pipette structure could be connected to an electrical potential, and the same voltage signal may be used to drive the reference electrode 28. An advantage of using an externally connected pre-charging element is that it is not necessary to pattern the top substrate hydrophobic coating to expose an electrode portion to the liquid reservoir. A further advantage is that it is possible in this arrangement for the hydrophobic coating 84 to extend into the input channel 82, which may be convenient for ease of manufacture.

Figure 12A:
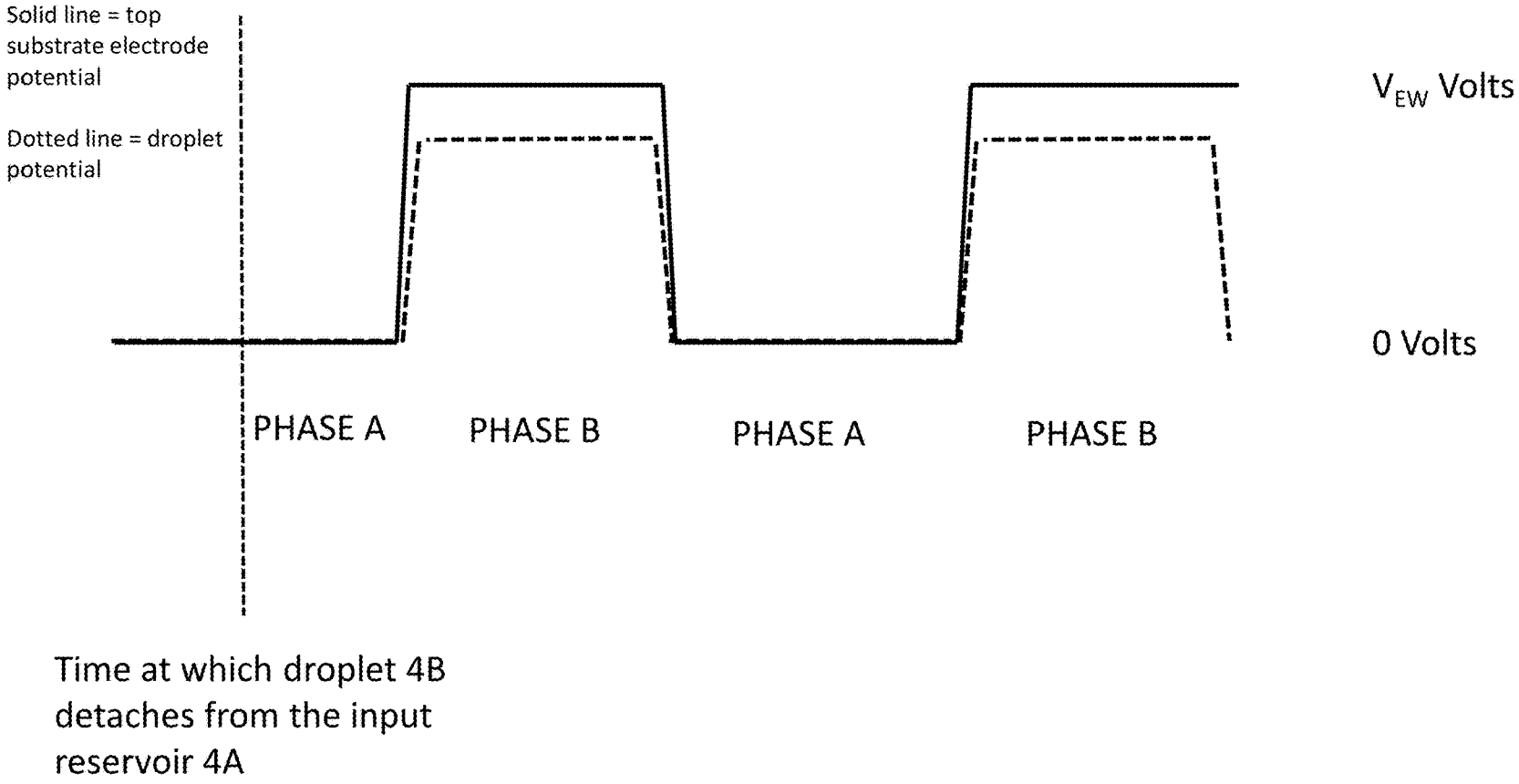
FIG. 12A and FIG. 12B are drawings depicting alternative methods of applying driving voltages in combination with pre-charging the liquid droplet reservoir.
Figure 12B:
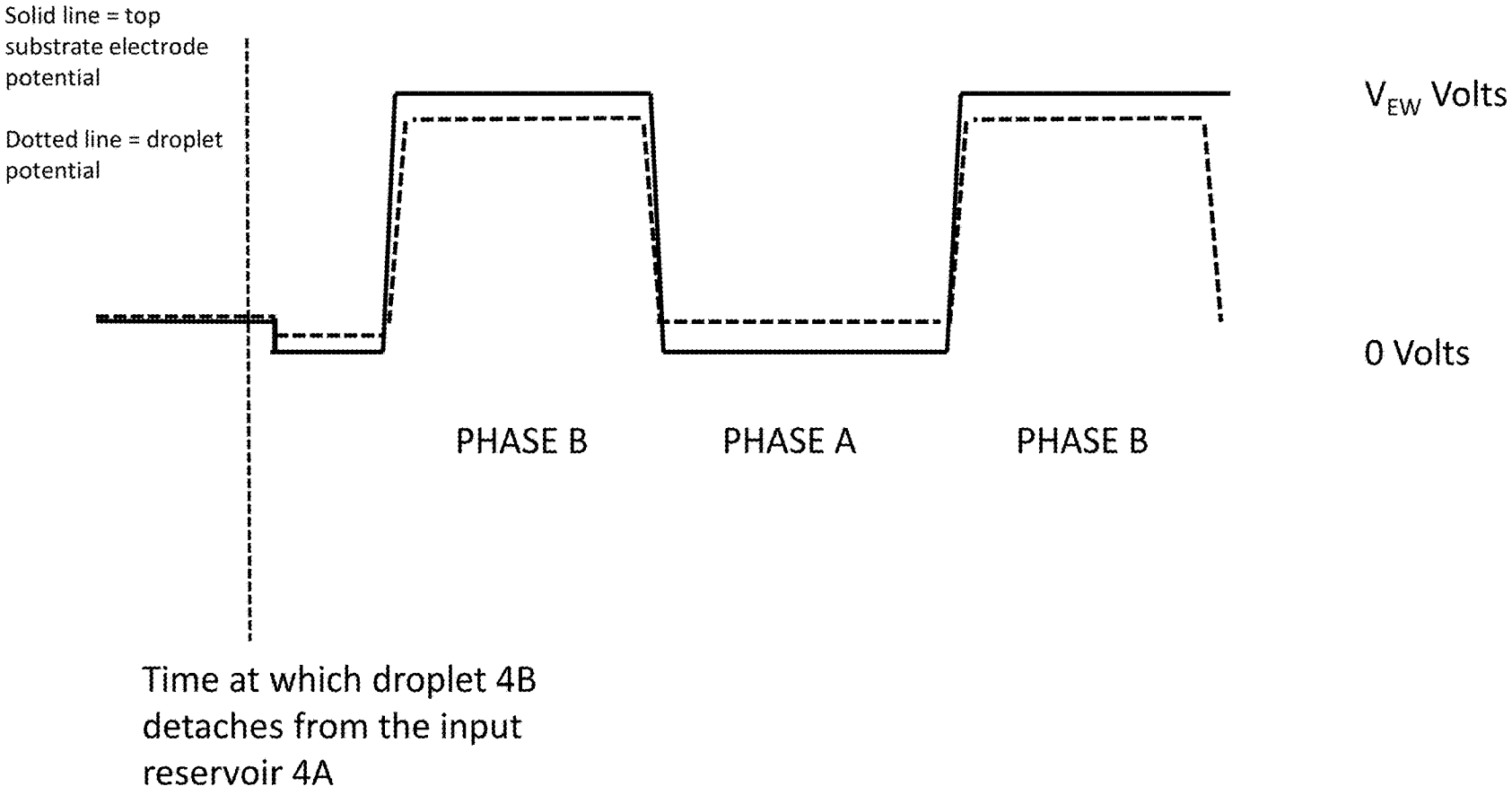

A method of operating an electro-wetting on dielectric (EWOD) device may be employed to pre-charge the input fluid reservoir. The operating method may include the steps of inputting a fluid reservoir input into the EWOD device via an input channel defined by the EWOD device; pre-charging the fluid reservoir with an electrical element while the input fluid reservoir is within the input channel; and applying an actuation voltage to the EWOD device to generate a liquid droplet from the input fluid reservoir and moving the fluid droplet into a gap defined by the EWOD device, wherein the droplet is moved to a portion of the gap that is electrically isolated from the electrical element such that the liquid droplet is at a floating electrical potential when located within said portion of the gap. FIGS. 12A and 12B are drawings depicting alternative methods of applying driving voltages in combination with pre-charging the liquid droplet reservoir 4A by exposing the droplet reservoir to a pre-charging potential in accordance with any of the embodiments set forth above.

FIG. 12A shows a conventional AC driving signal scheme. In this exemplary embodiment, an AC voltage pulse applied to the top substrate electrode is the same pulse as applied to bottom substrate electrodes during a state of unactuated droplets, or an antiphase pulse is applied to the bottom substrate electrodes for droplet actuation. In the exemplary embodiment depicted in FIG. 12A, during pre-charging an electrical potential of the input fluid reservoir is initialized at an electrical potential of the reference electrode, wherein upon AC signal transition of the actuation voltage a potential difference between the liquid droplet and reference electrode is essentially zero during a first phase of the AC signal transition and negatively offset during a second phase of the AC signal transition.

FIG. 12A thus shows the results of applying this conventional timing of voltage signals in combination with the droplet potential when the input fluid reservoir is pre-charged. The dotted line shows the potential of the droplet, with the solid line being the top substrate (reference) electrode potential. The droplet potential is initialized at the top substrate electrode potential (e.g., 0 volts). The droplet potential remains at 0 Volts until the droplet 4B is detached from the input fluid reservoir 4A as indicated by the vertical line. Upon the AC signal transition, the reference electrode potential goes to $V_{EW}$. If one or more of the lower substrate electrodes is actuated, the inventors have found that the droplet potential generally follows, but does not achieve a commensurate magnitude, as $V_{EW}$ as expected accordance with the relative capacitances of the insulating layers within the substrate.

Accordingly, in this embodiment, the potential difference between the droplet and the top substrate electrode is essentially zero at a first phase, Phase A, but is negatively offset at a second phase, Phase B, of the AC voltage signal.

An enhanced method of applying driving voltages in combination with pre-charging the liquid droplet reservoir driving is shown in FIG. 12B. In the embodiment of FIG. 12B, during pre-charging an electrical potential of the input fluid reservoir is initialized at an electrical potential that is offset relative to that of the reference electrode, wherein upon AC signal transition of the actuation voltage a potential difference between the liquid droplet and reference electrode has a positive offset value during a first phase of the AC signal transition and a negative offset value during a second phase of the AC signal transition. The result is that an average DC potential difference between the reference electrode and the liquid droplet over multiple cycles of the AC signal transition is approximately zero.

In particular, FIG. 12B shows that the top substrate electrode potential is made slightly positive of 0 Volts during the pre-charging initialization phase when droplet 4B is created from the input fluid reservoir 4A. Accordingly, droplet 4B is created from reservoir 4A having a small DC offset voltage relative to the actuation driving voltage. The result is that during AC transition, the droplet potential has a symmetrical relationship to the top substrate electrode potential, having a small positive offset value during a first phase, Phase A, and a small negative offset value during a second phase, Phase B, of the AC actuation signal. The driving method of FIG. 12B has the advantage that the average DC potential between the top substrate electrode and the droplet (averaged over many cycles) is zero or approximately zero.

An aspect of the invention, therefore, is an electrowetting on dielectric (EWOD) device having a pre-charging structure for pre-charging a fluid reservoir. In exemplary embodiments, the EWOD device includes a first substrate and an opposing second substrate defining a gap between the first and second substrates, each substrate including an insulating surface facing the gap; an array of elements comprising a plurality of individual elements that are actuatable for manipulation of a liquid droplet within the gap, each individual element including a plurality of electrode elements to which actuation voltages are applied; and a pre-charging structure that includes a channel in fluid communication with the gap and that is configured to receive a fluid reservoir for generation of the liquid droplet, and the pre-charging structure includes an electrical element electrically exposed to the channel. The electrical element pre-charges the fluid reservoir within the channel, and a portion of the gap containing the liquid droplet spaced apart from the channel is electrically isolated from the electrical element such that the liquid droplet is at a floating electrical potential when located within said portion of the gap. The EWOD device may include one or more of the following features, either individually or in combination.

In an exemplary embodiment of the EWOD device, the pre-charging structure comprises an input structure defining an input channel in fluid communication with the gap wherein the input channel is the channel that is configured to receive the input of the fluid reservoir, and the electrical element comprises an electrode portion of the plurality of electrode elements that is exposed to the input channel.

In an exemplary embodiment of the EWOD device, the plurality of electrode elements comprises an actuation electrode on the second substrate and a reference electrode on the first substrate, wherein the electrical element is a portion of the reference electrode that is exposed to the input channel.

In an exemplary embodiment of the EWOD device, the electrode portion and the insulating layer of the first substrate have a stepped configuration at the input channel such that multiple surfaces of the electrode portion are exposed to the input channel.

In an exemplary embodiment of the EWOD device, the electrode portion and the insulating layer of the first substrate have a straight configuration at the input channel such that only a single surface of the electrode portion is exposed to the input channel.

In an exemplary embodiment of the EWOD device, the plurality of electrode elements comprises a plurality of electrode elements that are positioned in a coplanar configuration on the second substrate; the input channel is cut from the gap through the insulating layer on the second substrate to at least a portion of at least one of the electrode elements to expose such portion of the electrode element to the input channel; and the electrical element is the portion of the electrode element that is exposed to the input channel.

In an exemplary embodiment of the EWOD device, the electrical element spans multiple electrode elements.

In an exemplary embodiment of the EWOD device, the electrical element comprises an externally connected pre-charging element that is inserted into the channel.

In an exemplary embodiment of the EWOD device, the pre-charging element comprises an electrical conductor connected to ground.

In an exemplary embodiment of the EWOD device, the plurality of electrode elements includes a reference electrode on the first substrate, and the pre-charging element comprises an electrical conductor that is connected to a same electrical supply that is connected to the reference electrode.

In an exemplary embodiment of the EWOD device, the channel comprises an input channel is defined by an extension of the insulating layer on the first substrate such that no portion of the electrode elements is exposed to the input channel.

In an exemplary embodiment of the EWOD device, the channel comprises an opening cut away through the top substrate to the gap.

In an exemplary embodiment of the EWOD device, the channel comprises a side opening between the first and second substrates that is in fluid communication with the gap.

In an exemplary embodiment of the EWOD device, the EWOD device further includes a side support that defines a portion of the input channel leading to the side opening.

In an exemplary embodiment of the EWOD device, the side support is electrically conductive.

In an exemplary embodiment of the EWOD device, the EWOD device further includes a plurality of offset setting structures in which an electrical element is in electrical connection with the gap, wherein at least one of the offset setting structures is spaced apart from an input structure for inputting the fluid reservoir.

Another aspect of the invention is an enhanced method of operating an electro-wetting on dielectric (EWOD) device. The method may include the steps of inputting a fluid reservoir into the EWOD device via a channel defined by the EWOD device; pre-charging the fluid reservoir with an electrical element while the input fluid reservoir is within the channel; and applying an actuation voltage to the EWOD device to generate a liquid droplet from the fluid reservoir and moving the liquid droplet into a gap defined by the EWOD device, wherein the droplet is moved to a portion of the gap that is electrically isolated from the electrical element such that the liquid droplet is at a floating electrical potential when located within said portion of the gap.

In one exemplary embodiment of the method, during pre-charging an electrical potential of the fluid reservoir is initialized at an electrical potential of the reference electrode, wherein upon AC signal transition of the actuation voltage a potential difference between the liquid droplet and reference electrode is zero during a first phase of the AC signal transition and negatively offset during a second phase of the AC signal transition.

In another exemplary embodiment of the method, during pre-charging an electrical potential of the fluid reservoir is initialized at an electrical potential that is offset relative to that of the reference electrode, wherein upon AC signal transition of the actuation voltage a potential difference between the liquid droplet and reference electrode has a positive offset value during a first phase of the AC signal transition and a negative offset value during a second phase of the AC signal transition. An average DC potential difference between the reference electrode and the liquid droplet over multiple cycles of the AC signal transition is approximately zero.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

INDUSTRIAL APPLICABILITY

The present invention finds application as a configuration of an enhanced microfluidic device. Such devices may be used to perform chemical or biological reactions, tests or the like. Applications may include healthcare diagnostic testing, material testing, chemical or biochemical material synthesis, proteomics, tools for research in life sciences and forensic science.

REFERENCE SIGNS LIST

4—liquid droplets
4A—liquid reservoir

4B—droplet
6—contact angle Θ
10—EWOD device
13—exemplary EWOD device
16—lower hydrophobic coating
20—insulator layer
26—upper hydrophobic coating
28—reference electrode
30—lower substrate
32—spacer
34—non-polar filler fluid
35—fluid gap
36—upper substrate
38—lower electrodes
38A—first lower electrode
38B—second lower electrode
40—fluid input structure
42—input channel
44—opening
46—electrode portion
50—second surface
52—offset setting structures
54—fluid input structure
56—electrode portion
58—single exposed surface
62—side opening input channel
63—side support
63B—electrically conductive side support
64—fluid input structure
66—electrode portion
68—first surface
70—second surface
72—input channel
74—fluid input structure
76/76A/76B—electrode portion
80—input structure
82—input channel
84—extension
86—pre-charging element
200—exemplary EWOD device
204—liquid droplets
216—first hydrophobic coating layer
220—insulator layer
226—second hydrophobic coating layer
228—second common reference electrode
230—first substrate
232—spacer
234—filler fluid
236—second substrate
238—set of element electrodes
239—element electrode
290—array of elements
292A—element
292B—element
292C—element
999—insulating layer

What is claimed is:

1. An electrowetting on dielectric (EWOD) device comprising:

a first substrate and an opposing second substrate defining a gap between the first and second substrates, each substrate including an insulating surface facing the gap;

an array of elements comprising a plurality of individual elements that are actuatable for manipulation of a liquid droplet within the gap, each individual element including a plurality of electrode elements to which actuation voltages are applied; and a pre-charging structure that includes a channel in fluid communication with the gap and that is configured to receive a fluid reservoir for generation of the liquid droplet, and the pre-charging structure includes an electrical element electrically exposed to the channel;

wherein the electrical element pre-charges the fluid reservoir within the channel, and a portion of the gap containing the liquid droplet spaced apart from the channel is electrically isolated from the electrical element such that the liquid droplet is at a floating electrical potential when located within said portion of the gap;

wherein the pre-charging structure comprises an input structure defining an input channel in fluid communication with the gap, wherein the input channel is the channel that is configured to receive the input of the fluid reservoir, and the electrical element comprises an electrode portion of the plurality of electrode elements that is exposed to the input channel;

wherein the plurality of electrode elements comprises an actuation electrode on the second substrate and a reference electrode on the first substrate, wherein the electrical element is a portion of the reference electrode that is exposed to the input channel; and wherein the electrode portion and the insulating layer of the first substrate have a stepped configuration at the input channel such that multiple surfaces of the electrode portion are exposed to the input channel.

2. An electrowetting on dielectric (EWOD) device comprising:

a first substrate and an opposing second substrate defining a gap between the first and second substrates, each substrate including an insulating surface facing the pap;

an array of elements comprising a plurality of individual elements that are actuatable for manipulation of a liquid droplet within the gap, each individual element including a plurality of electrode elements to which actuation voltages are applied; and a pre-charging structure that includes a channel in fluid communication with the gap and that is configured to receive a fluid reservoir for generation of the liquid droplet, and the pre-charging structure includes an electrical element electrically exposed to the channel;

wherein the electrical element pre-charges the fluid reservoir within the channel, and a portion of the gap containing the liquid droplet spaced apart from the channel is electrically isolated from the electrical element such that the liquid droplet is at a floating electrical potential when located within said portion of the gap;

wherein the pre-charging structure comprises an input structure defining an input channel in fluid communication with the gap, wherein the input channel is the channel that is configured to receive the input of the fluid reservoir; and wherein the electrical element comprises an externally connected pre-charging element that is inserted into the input channel and is located within the input channel spaced apart from the plurality of electrodes.

3. The EWOD device of claim 2, wherein the pre-charging element comprises an electrical conductor connected to ground.

4. The EWOD device of claim 2, wherein the plurality of electrode elements includes a reference electrode on the first substrate, and the pre-charging element comprises an electrical conductor that is connected to a same electrical supply that is connected to the reference electrode.

5. The EWOD device of claim 2, wherein the input channel is defined by an extension of the insulating layer on the first substrate such that no portion of the electrode elements is exposed to the input channel.

6. The EWOD device of claim 1, wherein the channel comprises an opening cut away through the top substrate to the gap.

7. An electrowetting on dielectric (EWOD) device comprising:

a first substrate and an opposing second substrate defining a gap between the first and second substrates, each substrate including an insulating surface facing the gap;

an array of elements comprising a plurality of individual elements that are actuatable for manipulation of a liquid droplet within the gap, each individual element including a plurality of electrode elements to which actuation voltages are applied; and a pre-charging structure that includes an input channel in fluid communication with the gap and that is configured to receive a fluid reservoir for generation of the liquid droplet within the gap, and the pre-charging structure includes an electrical element electrically exposed to the channel;

wherein the electrical element pre-charges the fluid reservoir within the channel, and a portion of the gap containing the liquid droplet spaced apart from the channel is electrically isolated from the electrical element such that the liquid droplet is at a floating electrical potential when located within said portion of the gap;

wherein the channel comprises a side opening between the first and second substrates that is in fluid communication with the gap;

wherein the EWOD device further includes a side support that defines a portion of the input channel leading to the side opening; and wherein the side support is electrically conductive.

8. The EWOD device of claim 1, further comprising a plurality of offset setting structures in which an electrical element is in electrical connection with the gap, wherein at least one of the offset setting structures is spaced apart from an input structure for inputting the fluid reservoir.

* * * * *